US010665950B2

(12) United States Patent
Yonei et al.

(10) Patent No.: US 10,665,950 B2
(45) Date of Patent: May 26, 2020

(54) COMPACT SLOT-TYPE ANTENNA

(71) Applicants: SEIKO SOLUTIONS INC., Chiba-shi, Chiba (JP); CHIKOUJI GAKUEN EDUCATIONAL FOUNDATION, Fukaya-shi, Saitama (JP); Misao Haneishi, Saitama-shi, Saitama (JP)

(72) Inventors: Yoshiyuki Yonei, Chiba (JP); Masahiro Sobu, Chiba (JP); Akinori Matsui, Fukaya (JP); Misao Haneishi, Saitama (JP)

(73) Assignees: SEIKO SOLUTIONS INC., CHIKOUJI (JP); IGAKUEN EDUCATIONAL FOUNDATION (JP); Misao Haneishi (JP)

( * ) Notice: Subject to any disclaimer, the term of this patent is extended or adjusted under 35 U.S.C. 154(b) by 50 days.

(21) Appl. No.: 15/512,734

(22) PCT Filed: Jul. 6, 2015

(86) PCT No.: PCT/JP2015/069440
§ 371 (c)(1),
(2) Date: Mar. 20, 2017

(87) PCT Pub. No.: WO2016/047234
PCT Pub. Date: Mar. 31, 2016

(65) Prior Publication Data

US 2019/0006766 A1 Jan. 3, 2019

(30) Foreign Application Priority Data

Sep. 22, 2014 (JP) ..... 2014-192480

(51) Int. Cl.
*H01Q 1/38* (2006.01)
*H01Q 13/08* (2006.01)
(Continued)

(52) U.S. Cl.
CPC ..... *H01Q 13/106* (2013.01); *H01Q 13/08* (2013.01); *H01Q 13/10* (2013.01); *H01Q 13/16* (2013.01)

(58) Field of Classification Search
CPC ..... H01Q 1/22; H01Q 1/2258; H01Q 1/2266; H01Q 1/2275; H01Q 1/2291; H01Q 1/24;
(Continued)

(56) References Cited

U.S. PATENT DOCUMENTS 4,197,544 A * 4/1980 Kaloi ..... H01Q 1/48 343/700 MS
4,197,545 A 4/1980 Favaloro et al. ..... 343/700
(Continued)

FOREIGN PATENT DOCUMENTS

CN 103199335 7/2013
CN 103367877 10/2013
(Continued)

OTHER PUBLICATIONS

International Search Report dated Sep. 29, 2015 in International Application No. PCT/JP2015/069440 together with English-language translation thereof.
(Continued)

*Primary Examiner* — Daniel Munoz
*Assistant Examiner* — Patrick R Holecek
(74) *Attorney, Agent, or Firm* — Adams & Wilks

(57) ABSTRACT

A compact slot-type antenna has a dielectric interposed between a conductor plate and a stripline. The conductor plate has a slot, and the stripline has a first line section extending in a longitudinal direction of the slot and a second line section extending in a direction orthogonal to the first line section and having one end connected to the first line section. The first line section lies wholly within a projection area of the slot and is electromagnetically coupled to the
(Continued)

conductor plate around the slot. A slit in the conductor plate extends from the slot to a side of the conductor plate which faces the first line section.

12 Claims, 14 Drawing Sheets

(51) Int. Cl.
*H01Q 13/10* (2006.01)
*H01Q 13/16* (2006.01)

(58) Field of Classification Search
CPC ..... H01Q 1/241; H01Q 1/242; H01Q 1/243; H01Q 1/245; H01Q 1/38; H01Q 13/08; H01Q 13/10; H01Q 13/106
See application file for complete search history.

(56) References Cited

U.S. PATENT DOCUMENTS

| | | | | |
|---|---|---|---|---|
| 4,531,130 | A | 7/1985 | Powers et al. | 343/767 |
| 8,138,984 | B2 * | 3/2012 | Chung | H01Q 1/2266 343/767 |
| 9,496,616 | B2 * | 11/2016 | Toyao | H01Q 13/10 |
| 9,728,858 | B2 * | 8/2017 | Zhu | H01Q 13/10 |
| 2009/0256765 | A1 | 10/2009 | Lu et al. | 343/767 |
| 2010/0103062 | A1 | 4/2010 | Chang et al. | 343/767 |
| 2010/0188294 | A1 | 7/2010 | Chung et al. | 343/700 |
| 2013/0127669 | A1 | 5/2013 | Han et al. | 393/700 |
| 2013/0257668 | A1 | 10/2013 | Rao et al. | 343/767 |
| 2013/0315511 | A1 | 11/2013 | Chen | 383/116 |
| 2014/0203993 | A1 | 7/2014 | Toyao | 343/687 |
| 2015/0002353 | A1 | 1/2015 | Kashino et al. | 343/770 |

FOREIGN PATENT DOCUMENTS

| | | |
|---|---|---|
| EP | 2343776 | 7/2011 |
| JP | 51071656 | 6/1976 |
| JP | 55028670 | 2/1980 |
| JP | 2006042254 | 2/2006 |
| JP | 4432782 | 1/2010 |
| JP | 2013247671 | 12/2013 |
| WO | 2011095969 | 8/2011 |
| WO | 2013027824 | 2/2013 |
| WO | 2014103311 | 7/2014 |

OTHER PUBLICATIONS

Nakaoka, K. et al. Slot Antenna Excited by a Strip Transmission Line, Bulletin of the Faculty of Engineering, Hokkaido University, cover page (Jun. 25, 1974), pp. 115-125.
Notice of Reasons for Rejection issued in Japanese Application No. JP2014-192480 dated Jun. 22, 2015 together with English-language translation thereof.
European Search Report dated May 18, 2018 in Application No. EP 15 84 4056.0.
Notice of Reasons for Rejection issued in Japanese Application No. JP2015-157274 dated Jun. 24, 2016 together with English-language translation thereof.
Chinese Office Action dated Apr. 15, 2019 in Application No. 201580050980.9 together with partial English-language translation thereof.
Chinese Office Action dated Oct. 29, 2018 in Application No. 201580050980.9 together with English-language translation thereof.
Communication dated Jan. 30, 2019 in Application No. 15 844 056.0.
European Examination Report dated Aug. 22, 2019 issued in Application No. 15 844 056.0.

* cited by examiner

SMITH CHART CHARACTERISTIC

RETURN LOSS CHARACTERISTIC

RADIATION EFFICIENCY=83.2%@2.44GHz

SMITH CHART CHARACTERISTIC

RETURN LOSS CHARACTERISTIC

RADIATION EFFICIENCY=86.7%@1.02GHz

SMITH CHART CHARACTERISTIC

RETURN LOSS CHARACTERISTIC

RADIATION EFFICIENCY=89.9%@2.40GHz

SMITH CHART CHARACTERISTIC

RETURN LOSS CHARACTERISTIC
RADIATION EFFICIENCY=80.0%@2.45GHz

FIG.6(a)
| S[mm] | RESONANCE FREQUENCY [GHz] | BANDWIDTH [MHz] | EFFICIENCY [%] |
|---|---|---|---|
| -4.5 | 1.89 | 103 | 75.0 |
| -3.5 | 2.11 | 175 | 80.0 |
| -2.5 | 2.44 | 260 | 82.9 |
| -1.5 | 2.93 | 375 | 83.2 |
| 0.5 | 3.81 | 1094 | 86.5 |
| 1.5 | 2.9 | 457 | 86.0 |
| 2.5 | 2.41 | 522 | 87.9 |
| 3.5 | 2.06 | 342 | 87.1 |
| 4.5 | 1.82 | 161 | 83.3 |
FIG.6(b)
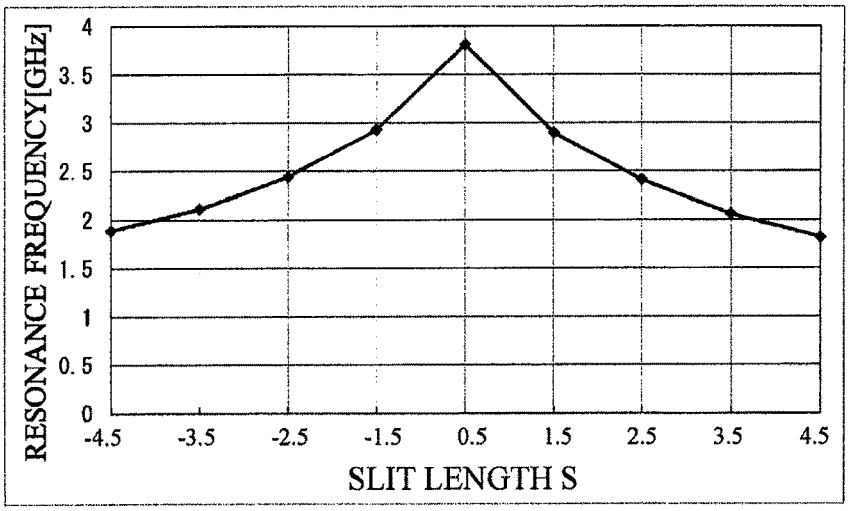
FIG.6(c)
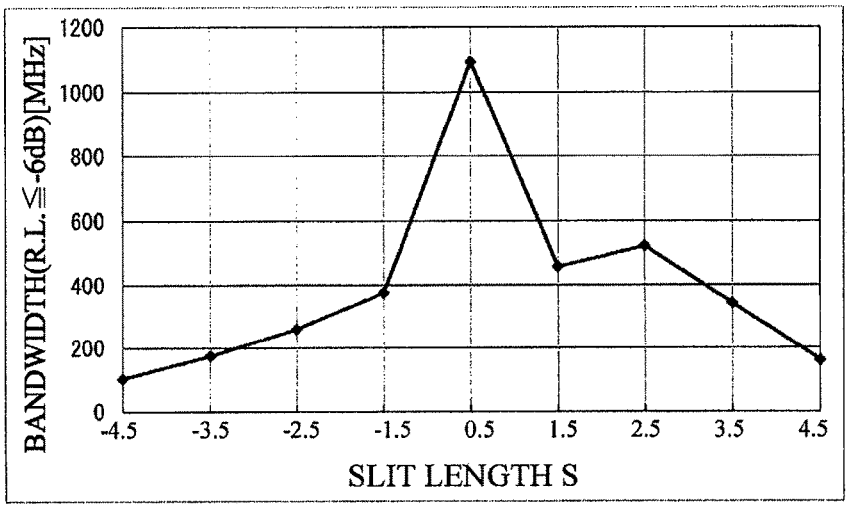

SMITH CHART CHARACTERISTIC

RETURN LOSS CHARACTERISTIC

RADIATION EFFICIENCY=82.7%@2.47GHz

SMITH CHART CHARACTERISTIC

RETURN LOSS CHARACTERISTIC

RADIATION EFFICIENCY=74.0%@2.42GHz

SMITH CHART CHARACTERISTIC

RETURN LOSS CHARACTERISTIC

RADIATION EFFICIENCY=75.0%@1.66GHz

SMITH CHART CHARACTERISTIC

RETURN LOSS CHARACTERISTIC

RADIATION EFFICIENCY=75.5%@1.64GHz

SMITH CHART CHARACTERISTIC

RETURN LOSS CHARACTERISTIC

RADIATION EFFICIENCY=74.8%@2.46GHz

OUTSIDE VIEW

Prior Art FIG.14(b)

RETURN LOSS CHARACTERISTIC

RADIATION EFFICIENCY=94.6%@2.43GHz

COMPACT SLOT-TYPE ANTENNA

TECHNICAL FIELD

The present invention concerns a compact slot-type antenna and relates to a slot antenna using a stripline for power feeding.

BACKGROUND ART

Radio equipment is widely used in respective fields of control, monitoring and so forth of consumer electrical appliances including cell phones. Then, in the radio equipment, an antenna miniaturization of which is possible while maintaining high radiation efficiency is required.

As the antenna which has been widely used conventionally, there exists the slot antenna. This slot antenna is the one which has been made so as form a slot of λ/2 in length and 0.01λ in width in a metal substrate in a case where a wavelength has been denoted by λ and to electrically connect an edge of the slot with a coaxial line.

On the other hand, a technology of feeding electric power to the slot by electromagnetic coupling by using the stripline, not directly feeding the electric power to the slot by electric connection is proposed in Non-Patent Literature 1. In addition, a proposal is made in regard to a configuration for facilitating establishment of matching with 50Ω power feeding and heightening a coupling rate and then heightening (not lowering) the radiation efficiency in the slot antenna.

FIG. 14 are the ones showing the antenna based on Non-Patent Literature 1.

As shown in FIG. 14, a slot 2 of about λ/2 (λ is the wavelength) in length is formed in the center of a metal substrate 1 of 100 mm×100 mm in length and breadth, and a stripline 4 is arranged in a direction intersecting with a longitudinal direction of the slot 2 with a dielectric 3 of 0.4 mm in thickness being interposed.

It is designed as the antenna of a frequency f of a slot antenna, where f=2.4 GHz band. Accordingly, it is formed such that a slot length is 54 mm and a slot width is 1.2 mm.

On the other hand, the stripline 4 projects from the slot 2 by λg/4 in length at a leading end 5 (the upper side) thereof as shown by an arrow Q in order to heighten the radiation efficiency by heightening an amount of coupling (a state of impedance matching) with the 50Ω power feeding. Λg denotes a propagation wavelength of the frequency at which resonance just occurs on the stripline 4 when the slot length is a.

In addition, the stripline 4 is arranged at a position which has been offset from the center in a length direction of the slot 2 to the left side by 20 mm in order to facilitate establishment of the impedance matching.

A not shown high frequency circuit is connected to the other end (the lower side) of the stripline 4.

According to this slot antenna, it is possible to easily produce an antenna section having the slot and a power feeding section by photoetching and so forth in comparison with a case of direct power feeding via a coaxial line.

However, in the slot antenna described in Non-Patent Literature 1, it is necessary to project (a part marked with the arrow Q) the stripline 4 from the slot 2 by λg/4 in length.

Accordingly, there was such a problem that the size of the antenna becomes large.

CITATION LIST

Non-Patent Literature

Non-Patent Literature 1: "Slot Antenna Excited by Stripline" written by Kaijiro NAKAOKA, Kennichi KIMURA, Yasuhiko ITOH, Tadashi MATSUMOTO, Jun. 25, 1974 (Hokkaido University)

DISCLOSURE OF THE INVENTION

Problems to be Solved by the Invention

Accordingly, the present invention aims to more miniaturize the compact slot-type antenna that the slot and the stripline have been electromagnetically coupled together.

SUMMARY OF THE INVENTION

The invention according to one aspect provides a compact slot-type antenna, characterized by comprising: a conductor plate in which a slot has been formed; a stripline having a first line section which has been formed in a longitudinal direction of said slot, and a second line section which has been arranged in a direction orthogonal to said first line section and one end of which has been connected with said first line section; and a dielectric which has been arranged between said conductor plate and said stripline, wherein said first line section of said stripline is arranged in a projection area of said slot and is electromagnetically connected with said conductor plate around said slot by power feeding from said second line section.

The invention according to another aspect provides a compact slot-type antenna, wherein said conductor plate is, a slit is formed from said slot to a side of said conductor plate which faces a long side of said first line section.

The invention according to another aspect provides a compact slot-type antenna, wherein said slit is formed from a long side of said slot to said side of said conductor plate.

The invention according to another aspect provides a compact slot-type antenna, wherein said conductor plate is provided with a slot end substrate section which is configured between said slot and said side of said conductor plate, and an inward-extended section which has been formed by extending from said slot end substrate section into said slot, and said slit is formed by extending into said slot through between a side in a transverse direction of said slot and said inward-extended section.

The invention according to another aspect provides a compact slot-type antenna, wherein said conductor plates are arranged plural-layeredly at a predetermined interval and are via-connected with one another, and said stripline is arranged on the same plane as any one of said conductor plates.

The invention according to a further aspect provides a compact slot-type antenna, wherein said conductor plates are arranged plural-layeredly at a predetermined interval and are via-connected with one another, and said stripline is, the plurality of said first line sections are arranged for every said layer and are via-connected with one another, and the second liner section is electrically connected with the first line section which has been arranged in the layer concerned in any of said layers.

The invention according to another aspect provides a compact slot-type antenna, wherein said stripline is offset from the center in a width direction of said second line section and the center of a long side of said slot in any one of left and right directions.

Effect of the Invention (a) According to the present invention, since it has been configured such that the first line section of the stripline is arranged in the projection area of the slot so as to be electromagnetically connected with the conductor plate around the slot by power feeding from the second line section, it becomes possible to more miniaturize the compact slot-type antenna.

(b) According to one aspect of the invention, since the slit is formed from the slot to the side of the conductor plate, in a case where the same resonance frequency has been set as a standard, it becomes possible to more miniaturize it.

(c) According to another aspect of the invention, since the slit is formed so as to extend into the slot through between the side in the transverse direction of the slot and the inward-extended section which has been formed by extending into the slot, it becomes possible to more miniaturize it.

(d) According to another aspect of the invention, since the conductor plates are arranged plural-layeredly at the predetermined interval and are via-connected with one another, in the case where the same resonance frequency has been set as the standard, it becomes possible to more miniaturize it.

BRIEF DESCRIPTION OF THE DRAWINGS

FIG. 6 are explanatory diagrams that comparison has been made in regard to a resonance frequency, a bandwidth BW, efficiency, depending on whether a direction in which the slit is formed is an outward-directed slit or an inward-directed slit.

DESCRIPTION OF EMBODIMENTS

Figure 1A:
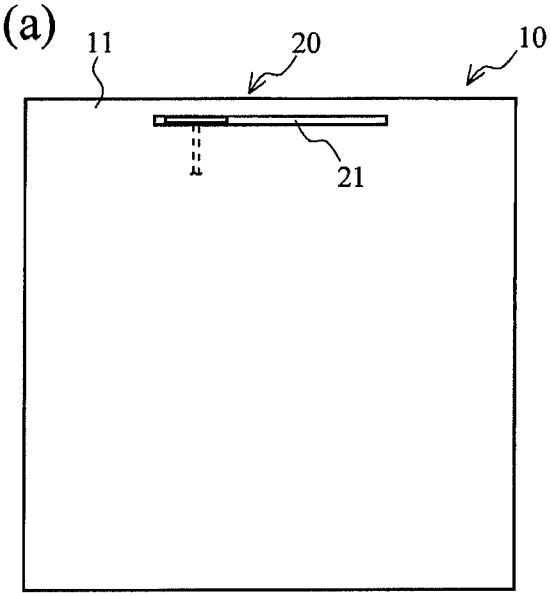
FIG. 1 are explanatory diagrams showing a configuration and characteristics of a first embodiment in a compact slot-type antenna.
Figure 1B:
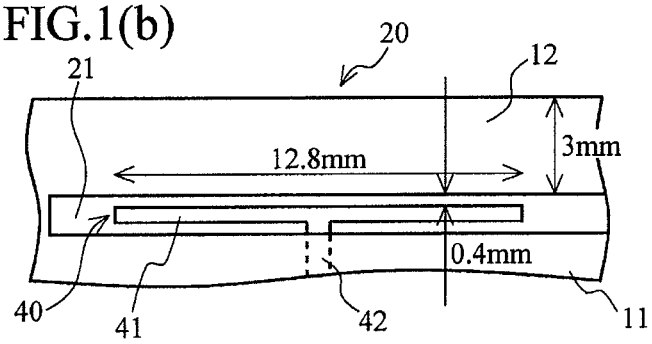
Figure 1C:
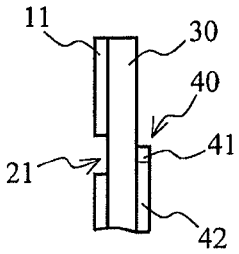
Figure 1D:
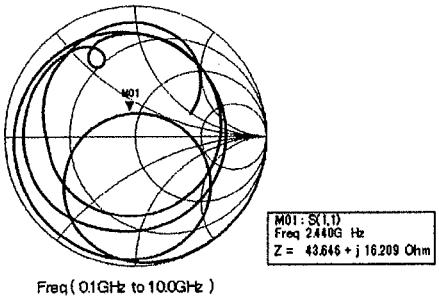
Figure 1E:
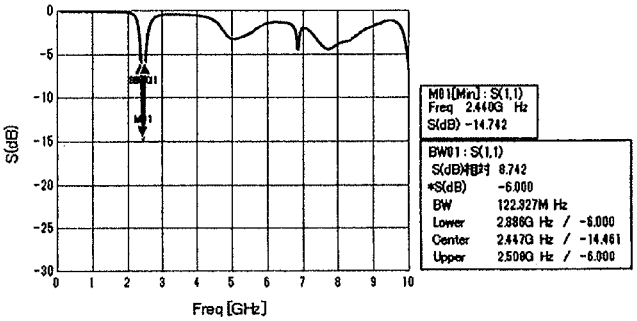
Figure 2A:
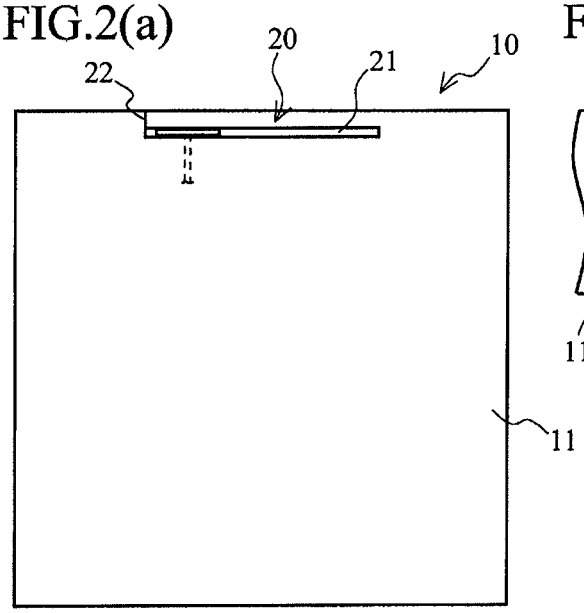
FIG. 2 are explanatory diagrams showing a configuration and characteristics of a compact slot-type antenna that a slit has been formed in a slot end part.
Figure 2B:
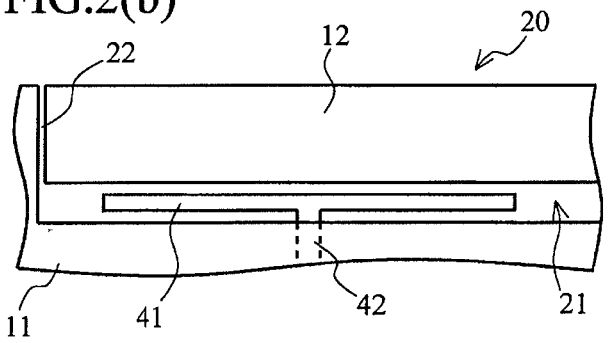
Figure 2C:
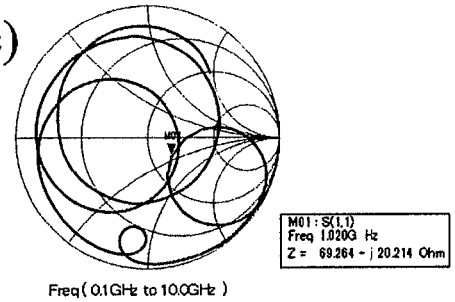
Figure 2D:
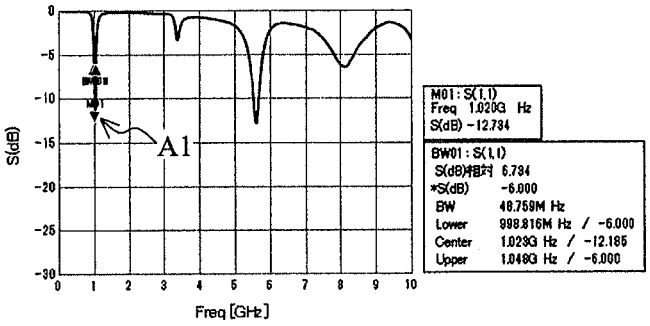

In the following, preferred embodiments of a compact slot-type antenna of the present invention will be described in detail with reference to FIG. 1 to FIGS. 13.

(1) Summary of Embodiments

A compact slot-type antenna 20 of the present embodiment has a dielectric 30, a metal substrate 11 (function as a conductor plate) which has been arranged on one surface thereof with this dielectric 30 being interposed, and a stripline 40 which has been arranged on the other surface thereof.

A slot 21 is formed in the metal substrate 11. The following configuration is adopted in order to further conduct miniaturization while maintaining matching with power feeding and radiation efficiency by performing not direct power feeding (electric connection) but electromagnetic coupling type power feeding that the electric power is fed to the metal substrate 11 around the slot 21 by electromagnetic coupling by using the stripline 40.

The stripline 40 is configured by a first line section 41 which extends in a longitudinal direction of the slot 21, and a second line section 42 which is connected with this first line section 41 and extends in a direction (a right-angled direction in the embodiment) intersecting with it.

The first line section 41 is arranged (hereinafter, simply called an arrangement in the slot) in a projection area (a virtual area which is projected in a case where the slot 21 has been irradiated with parallel light) of the slot 21. Stated another way, the stripline 40 is positioned relative to the metal substrate 11 such that the slot 21 completely overlies the first line section 41, i.e., the first line section 41 fits completely inside the slot 21.

The second line section 42 is connected to the first line section 41 on one-end side and is connected to a high frequency circuit on the other-end side. Both of a case where the one-end side of the second line section 42 is connected with one end of the first line section 41 (called an L-shaped type) and a case where it is connected between the both ends of the first line section 41 (called a T-shaped type) are possible. In the case of the T-shaped type, both of a case where the second line section 42 is connected to the center of the first line section 41 and a case where it is connected in a state of deviating to any one of the left and right sides are also possible.

The first line section 41 functions as an electromagnetic coupling type power feeding section which is electromagnetically coupled with the metal substrate 11 around the slot 21 and, on the other hand, the second line section 42 functions as a power feeding line which supplies the electric power fed from the high frequency circuit to the first line section 41. That is, the electric power fed from the second line section 42 is electromagnetically supplied via the first line section 41.

According to the present embodiment, since the leading end section (the first line section 41) of the stripline 40 is arranged in the slot and is not present on the outside (the outside of the projection area) of the slot 21, it can be made into the compact slot-type antenna which has used the stripline 40.

In addition, further miniaturization is realized by forming a slit from the slot 21 to the end of the metal substrate 11 in which the slot 21 is formed on the one-end side in the length direction of the slot 21.

This makes further miniaturization possible for a target resonance frequency on the basis of such a new finding that when the slit from the slot 21 to the metal substrate 11 end is formed in the metal substrate 11 in which the slot 21 is formed, the resonance frequency is lowered in the case of the slot 21 of the same size.

In the present embodiment, the slot 21 is arranged such that an end face of the metal substrate 11 and the long side of the slot 21 come into parallel with each other at a position which is remote from the metal substrate 11 by several millimeters (for example, 3 mm).

A slot length can be made into the size of about ⅓ by forming the slit.

Further, since a length for the slit to be formed becomes necessary, the slit is formed in the slot 21. Specifically, the slot 21 is set at a position which is remote from the end face of the metal substrate 11 by zero point several millimeters (for example, 0.5 mm) and the slit is formed in the slot 21 end.

Then, an inward-extended section which has been extended from an end (the end on the free-end side formed with the slit) of the metal substrate 11 between the slot 21 and the metal substrate 11 end face into the slot 21 such that the slit extends into the slot 21. Thereby, the slit which has been extended is formed between the slit-side short side of the slot 21 and the inward-extended section. In the present specification, the slit in a case where the inward-extended section has been formed will be called an inward-directed slit and the slit which has been formed from the slot 21 to the metal substrate 11 end face without forming the inward-extended section will be called an outward-directed slit.

Since it becomes possible to bring the slot 21 closer to the metal substrate 11 end face while ensuring the slit length by making the slit into the inward-directed slit, it becomes possible to more miniaturize the antenna.

Although it is also possible to make the compact slot-type antenna of the present embodiment by one layer (two layers when the stripline 40 is included) in a case where the number of the metal substrates 11 has been set as the standard, it is also possible to form it by the plurality of layers.

(2) Details of Embodiment (First Embodiment)

FIG. 1 are explanatory diagrams showing a configuration and characteristics of the first embodiment in the compact slot-type antenna.

FIG. 1(*a*) shows the entire of a compact slot-type antenna module 10 equipped with the compact slot-type antenna 20 of the present embodiment, and (b) and (c) are a plan view that the compact slot-type antenna 20 part has been enlarged and the one that part of the section has been enlarged.

The compact slot-type antenna module 10 is equipped with the metal substrate 11 which functions as an excitation plate and the stripline 40 and is configured by the single layer (the two layers in the case where the stripline 40 has been included) in the case where the number of the metal substrate 11 has been set as the standard.

The compact slot-type antenna module 10 is equipped with the dielectric 30 of 0.4 mm in thickness, the metal substrate 11 is arranged on one side thereof and the stripline 40 is arranged on the other side with this dielectric 30 being interposed.

The metal substrate 11 and the dielectric 30 are formed into square shapes of 100 mm in length and 100 mm in width.

Although the metal substrate 11 in each embodiment which will be described is made of copper of a conductivity $\sigma=5.977\times10\ \{7\}$ [S/m], it is also possible to use other materials. Incidentally, {7} in the notation 10{7} denotes an index which indicates a power.

Likewise, the dielectric 30 in each embodiment which will be described functions as an insulation layer and a case where a glass epoxy substrate (a dielectric constant $\varepsilon r=4.25$) has been used will be described. However, it is also possible to use a Teflon fiber substrate (the dielectric constant $\varepsilon r\div2.6$), a ceramic substrate (the dielectric constant $\varepsilon r\div10.0$) and so forth in addition thereto (Teflon is a registered trademark). And an air layer may be adopted also as the dielectric.

The compact slot-type antenna module 10 of the present embodiment is formed with the compact slot-type antenna 20 in the vicinity of one side thereof. In the following, in the present embodiment, a case where the compact slot-type antenna 20 is designed as an antenna of a resonance frequency f=2.4 GHz will be described by way of example.

The slot 21 which configures the compact slot-type antenna 20 is formed remote from one side of the metal substrate 11 by a predetermined distance m (in the present embodiment, m=3 mm). In the following, a part of the predetermined distance m from one side of the metal substrate 11 to the slot 21 will be called a slot end substrate section 12. A width (=the predetermined distance m) of the slot end substrate section 12 is 3 mm in the present embodiment and the compact slot-type antenna 20 is arranged on an end of the metal substrate 11 in comparison with the conventional slot antenna (see FIG. 14) that the slot has been arranged on the center).

The size of the slot 21 is 47 mm in length in the longitudinal direction and 1.2 mm in width in the transverse direction.

The stripline 40 which functions as a power feeding line to the antenna and configures part of the compact slot-type antenna 20 is arranged on the opposite side of the dielectric 30, facing the metal substrate 11. The stripline 40 is equipped with the first line section 41 which extends in the longitudinal direction of the slot 21 and the second line section 42 which is connected to the middle in the longitudinal direction of this first line section 41.

Figure 14A:
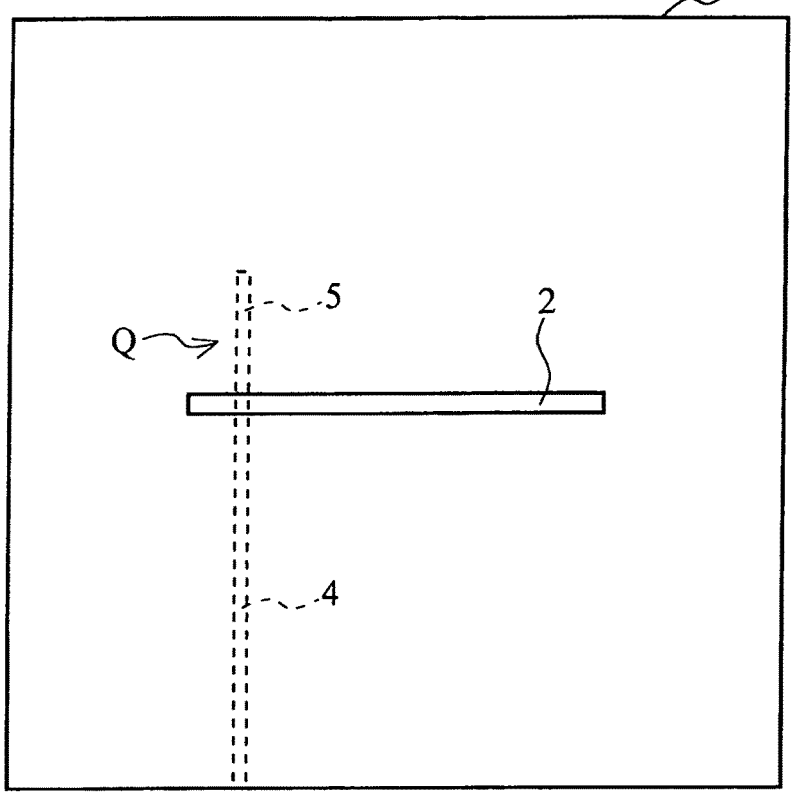
FIG.14(a) Prior Art
FIG. 14 are explanatory diagrams of the slot antenna based on Non-Patent Literature 1.
Figure 14A:
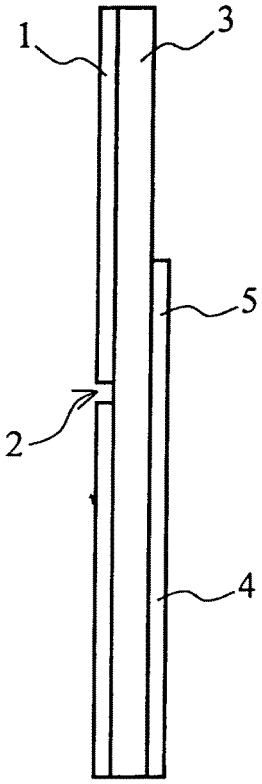
FIG.14(a) Prior Art
Figure 14C:
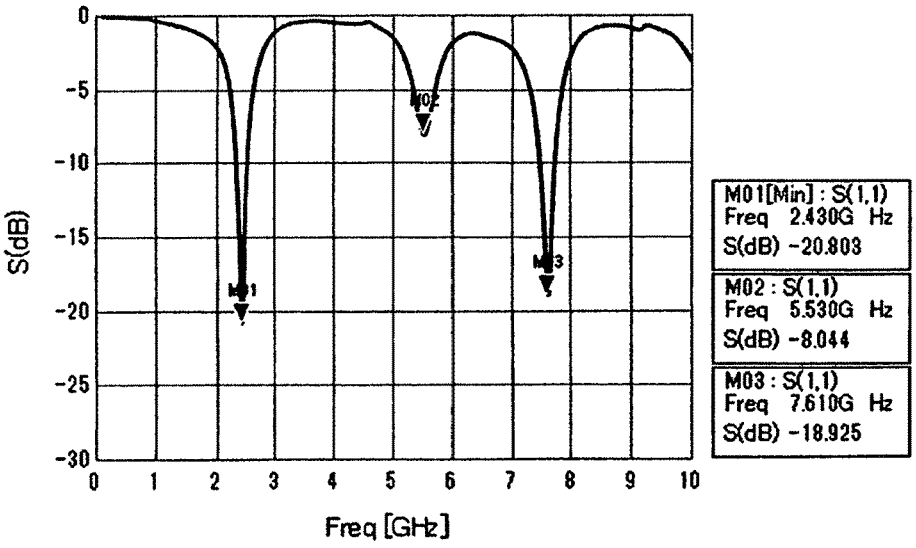
FIG.14(c) Prior Art

Incidentally, the size of the slot 21 of the present embodiment is slightly shorter in length in comparison with the length (54 mm) of the conventional slot antenna shown in FIG. 14.

This is because the compact slot-type antenna 20 has been adjusted so as to achieve the resonance frequency f=2.4 GHz band in the shape (in particular, the shape and the arrangement of the stripline 40 which will be described later) of the present embodiment.

The second line section 42 is 0.8 mm in width thereof, the one-end side is connected to the center of the first line section 41 and the other-end side is connected to the high frequency circuit (not shown).

The first line section 41 is formed to be 6 mm in left-side length thereof, 6 mm in right-side length, 12.8 mm in overall length, relative to the second line section 42 (0.8 mm in width). This first line section 41 is arranged in the projection area (the virtual area that the slot 21 is projected to the dielectric 30 with the parallel light) of the slot 21.

In the both long sides of the first line section 41, a space (a gap) between one side on the side to which the second line section 42 is not connected and the other side of the slot 21 side is 0.4 mm.

This stripline 40 is offset from the center of the slot 21 to any one side (the left side in FIG. 1) in its length direction by 15 mm. That is, the stripline 40 is arranged such that the center in a width direction of the second line section 42 is located at a position which has been remote from the center in the length direction of the slot 21 in a left direction by 15 mm.

FIGS. 1(*d*), (*e*) show simulation results in regard to a Smith chart characteristic and a return loss characteristic in regard to the compact slot-type antenna 20 in the first embodiment (also other drawings are the same).

As shown in FIG. 1(*d*), the compact slot-type antenna 20 of the first embodiment is broad in bandwidth (the bandwidth BW=122.327 MHz) that a frequency range that a reflection loss is not more than −6 dB is 2.386 GHz to 2.508 GHz and a central frequency of that bandwidth is 2.447 GHz. It can be easily estimated that this broadband characteristic makes it possible to sufficiently cover, for example, the 2.4 GHz band of a wireless LAN by adjusting the resonance frequency.

In addition, according to the compact slot-type antenna 20, although the radiation efficiency is lowered by a little less than 10% in comparison with the conventional one, the radiation efficiency at 2.44 GHz is $\eta$=83.2% and the sufficient characteristics as the antenna are ensured.

In addition, as shown by a Smith chart in FIG. 1(*d*), critical coupling is mostly obtained at 2.440 GHz. Thereby, it is seen that coupling of the antenna with the stripline 40 (the power feeding line) to be connected with the high frequency circuit is very favorable.

As described above, in the compact slot-type antenna 20 of the first embodiment, in the stripline 40, the first line section 41 adapted to heighten the coupling amount and then to heighten the radiation efficiency is arranged in the projection area of the slot 21. Since the projection part (the arrow Q part in FIG. 14) from the slot of the stripline is not present in this way, it becomes possible for the compact slot-type antenna 20 of the present embodiment to miniaturize the antenna size.

In addition, since there is no projection part of the stripline, it becomes possible to form the slot 21 close to the vicinity of the end of the metal substrate 11 and a degree of freedom in position where the compact slot-type antenna 20 is to be arranged is improved by that amount.

(3) Other Embodiments

Next, other embodiments that the compact slot-type antenna 20 of the first embodiment has been more miniaturized will be described.

The compact slot-type antennas 20 of the second and succeeding embodiments realize further miniaturization by arranging the first line section 41 in the projection area of the slot 21 similarly to the first embodiment and further forming a slit 22 from the slot 21 to the end of the metal substrate 11 in the slot end substrate section 12.

FIG. 2 are explanatory diagrams showing the configuration and the characteristics of the compact slot-type antenna that the slit has been formed in the slot end.

FIGS. 2(*a*), (*b*) show the configuration of the compact slot type antenna 20. Incidentally, the side section of the antenna part is the same as that in FIG. 1(*c*) and therefore it is omitted.

In the compact slot-type antenna 20 shown in FIG. 2, the slit 22 of 0.1 mm in width is formed in the slot end substrate section 12 from the end of the metal substrate 11 to the slot 21. Although the slit 22 is formed in the left-side end in the longitudinal direction of the slot 21 in FIG. 2, it may be formed in other places, for example, the right side end, between the left-side end and the central part, between the right-side end and the central part, not limited to this.

The compact slot-type antenna 20 in FIG. 2 is the same in configuration as the compact slot-type antenna 20 shown in FIG. 1 in shape, size and so forth excluding this slit 22. That is, the slot 21 is 47 mm in length and 1.2 mm in width as in the FIG. 1 example and the slit 22 is 0.1 mm in width, which is substantially narrower than the width of the slot 21.

While in the compact slot-type antenna 20 described in FIGS. 1, the resonance frequency thereof (a fundamental frequency) is 2.44 GHz, in the compact slot-type antenna 20 that the slit 22 has been formed in the same configuration as that, the resonance frequency (the fundamental frequency) is lowered to f=1.02 GHz as shown by Al in the return loss characteristic in FIG. 2(*d*).

From this, such a new finding that if it has the same size, the resonance frequency will be lowered (it is possible to lower the resonance frequency) by forming the slit in the compact slot-type antenna of the same size was obtained.

That is, the finding that if it is in the same resonance frequency band (f=2.4 GHz band), the size of the slot-type antenna can be made smaller by forming the slit 22 which is linked with the slot 21 was obtained.

Accordingly, in each embodiment succeeding to the second embodiment, each compact slot-type antenna 20 that the slit has been provided in the slot end substrate section 12 will be described.

Figure 3A:
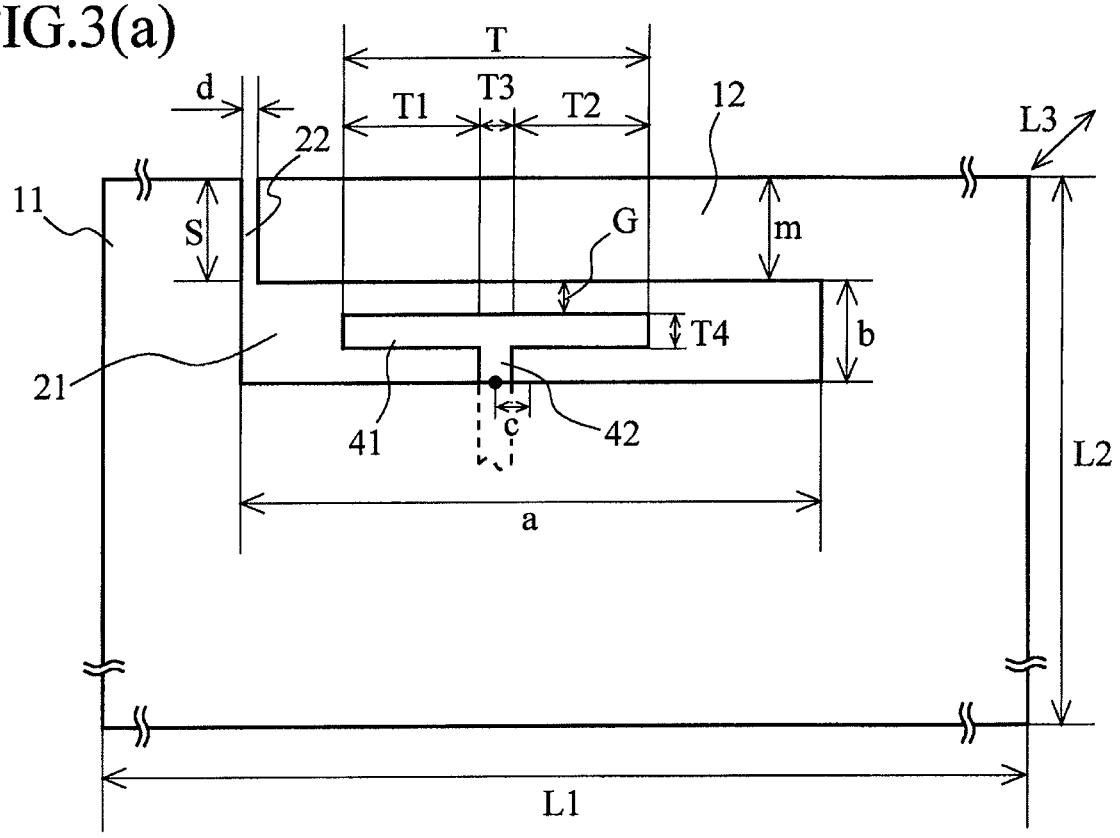
FIG. 3 are explanatory diagrams showing a definition of each section of the compact slot-type antenna, parameters for defining the size thereof in each embodiment succeeding to a second embodiment.
Figure 3B:
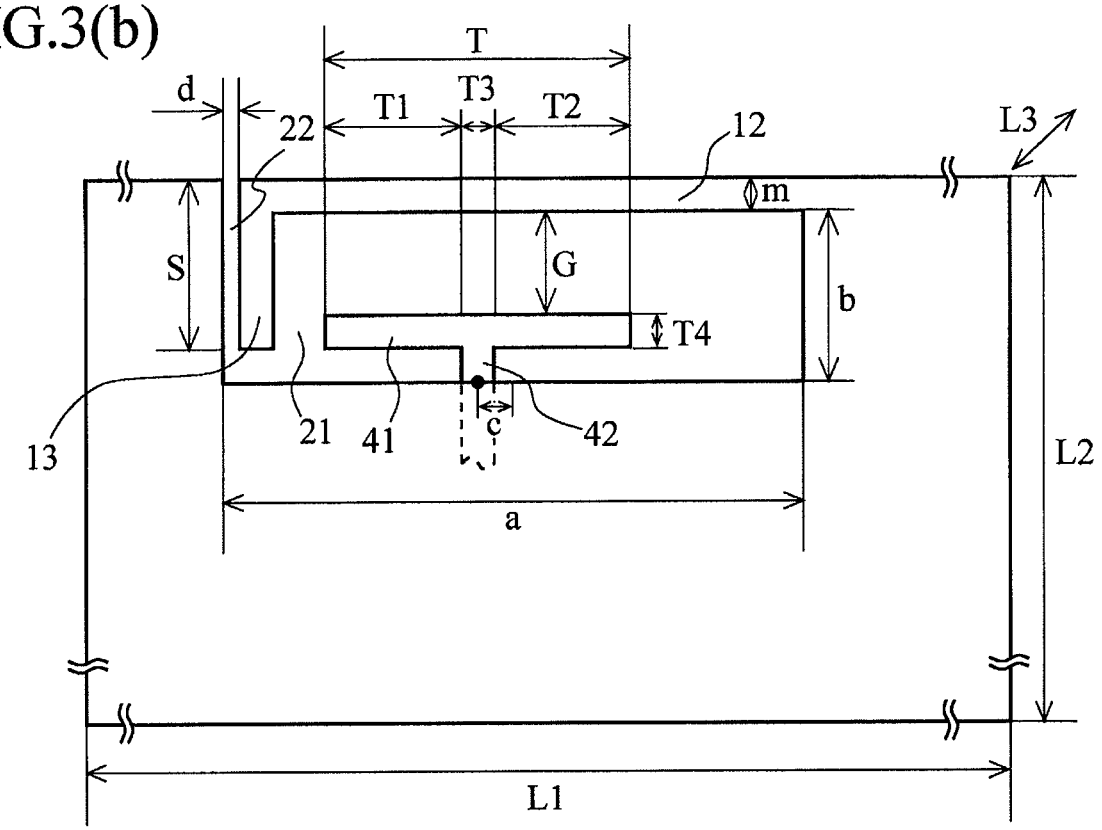
Figure 4A:
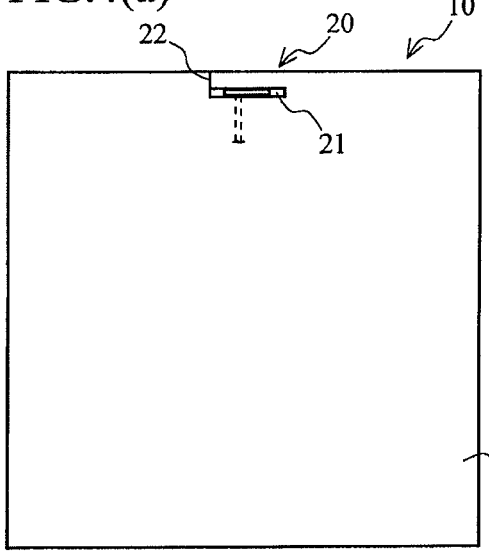
FIG. 4 are explanatory diagrams showing a configuration and characteristics of the second embodiment in the compact slot-type antenna.
Figure 4B:
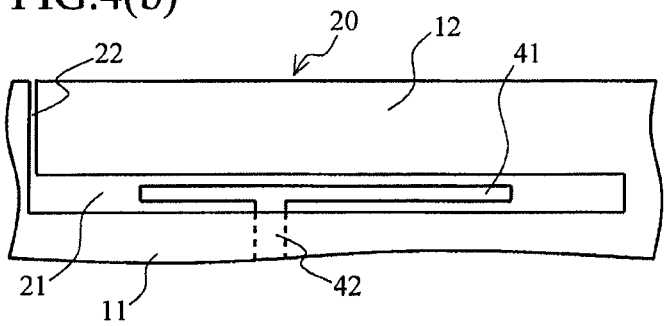
Figure 4C:
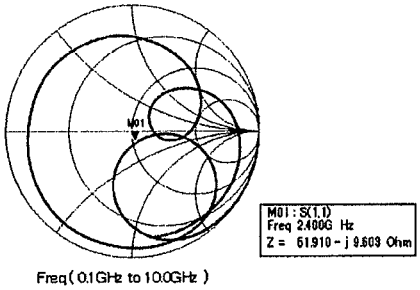
Figure 4D:
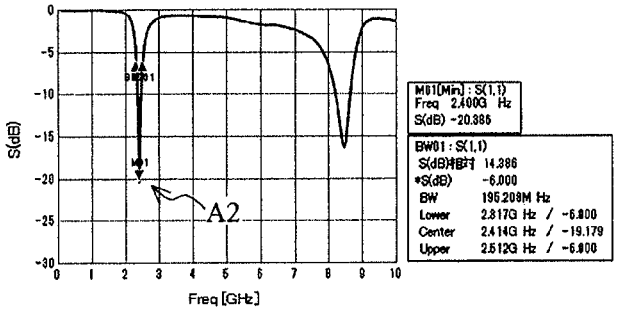
Figure 5A:
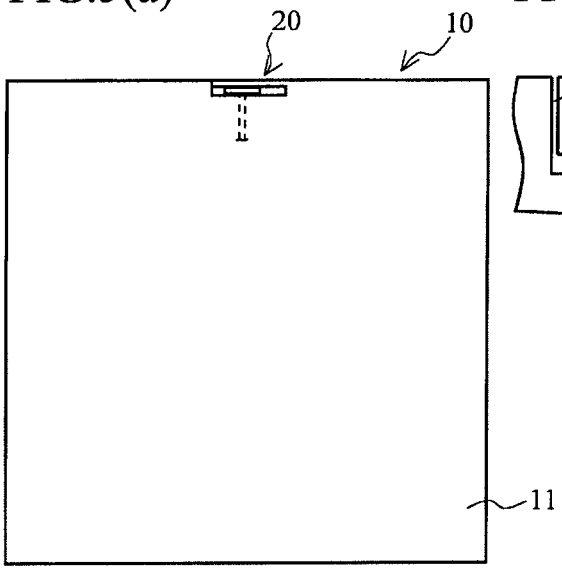
FIG. 5 are explanatory diagrams showing a configuration and characteristics of a third embodiment in the compact slot-type antenna.
Figure 5B:
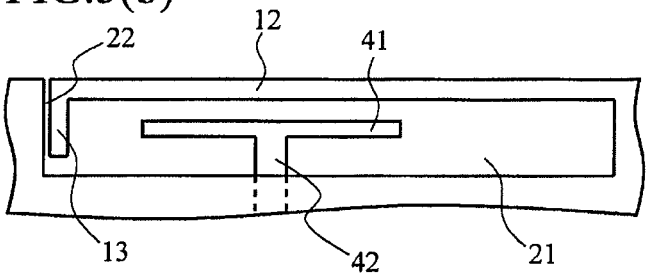
Figure 5C:
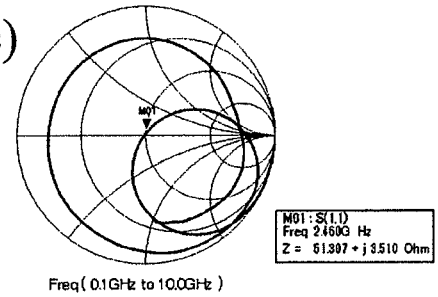
Figure 5D:
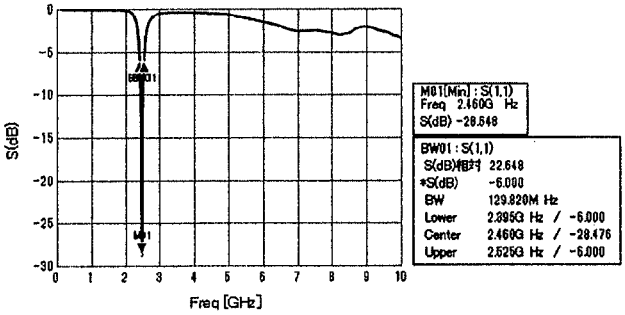
Figure 7A:
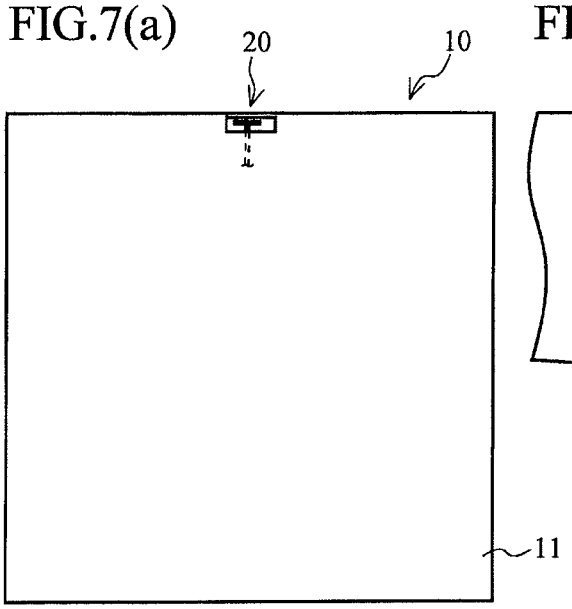
FIG. 7 are explanatory diagrams showing a configuration and characteristics of a compact slot-type antenna in a fourth embodiment.
Figure 7B:
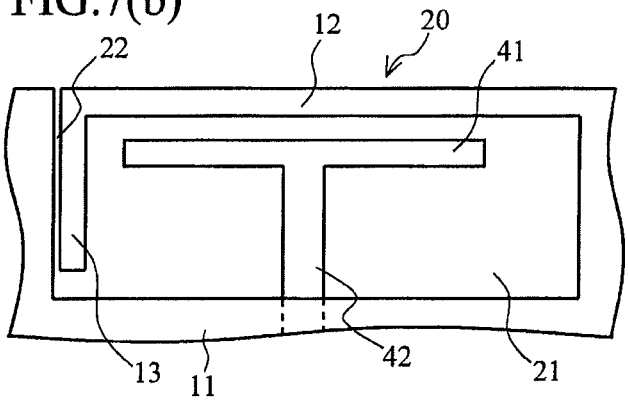
Figure 7C:
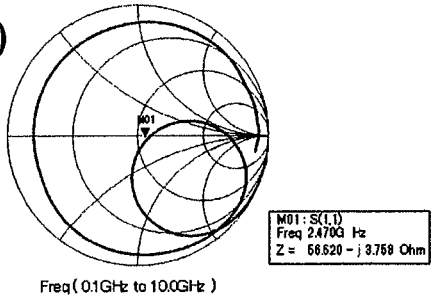
Figure 7D:
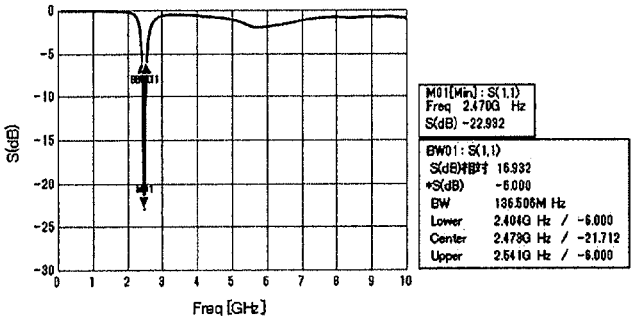
Figure 8A:
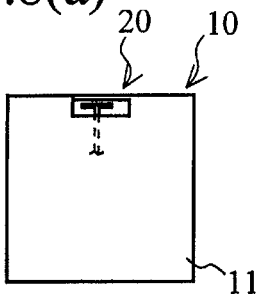
FIG. 8 are explanatory diagrams showing a configuration and characteristics of a compact slot-type antenna in an altered example of the fourth embodiment.
Figure 8B:
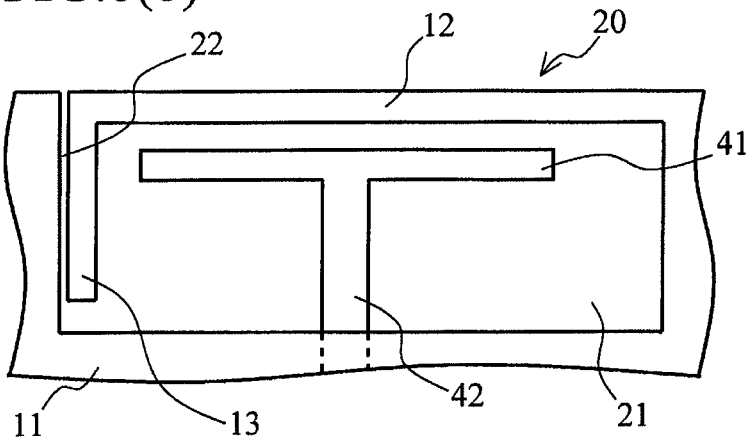
Figure 8C:
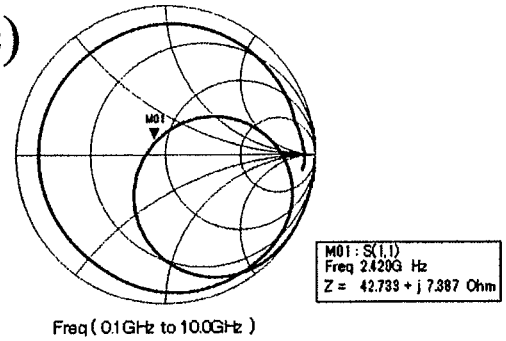
Figure 8D:
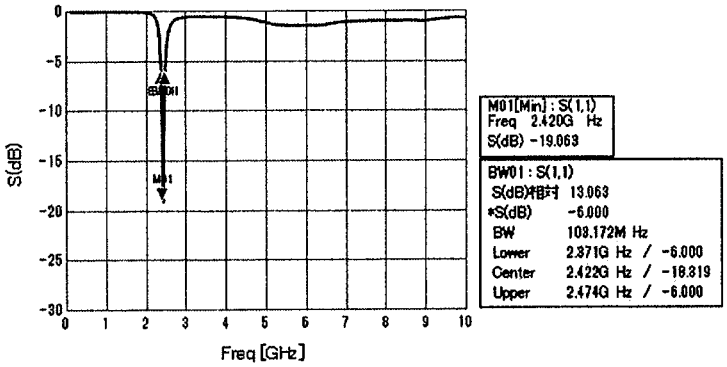
Figure 9A:
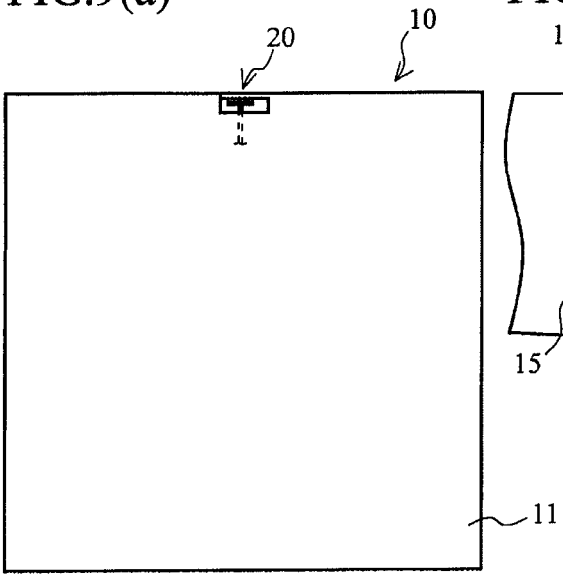
FIG. 9 are explanatory diagrams showing a configuration and characteristics of a compact slot-type antenna in a fifth embodiment.
Figure 9B:
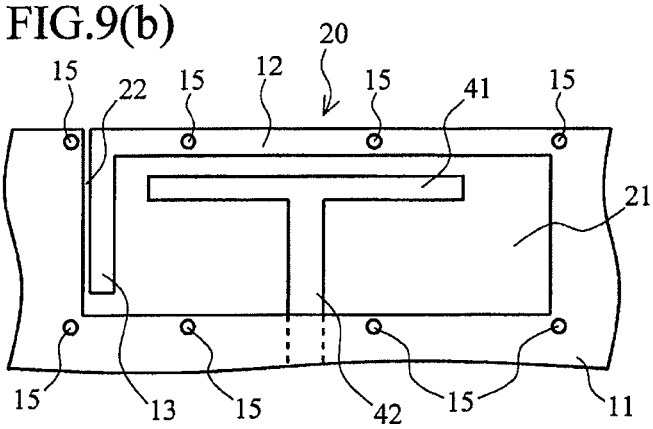
Figure 9C:
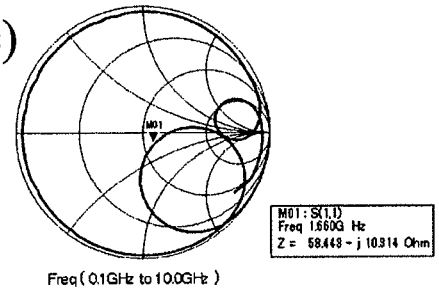
Figure 9D:
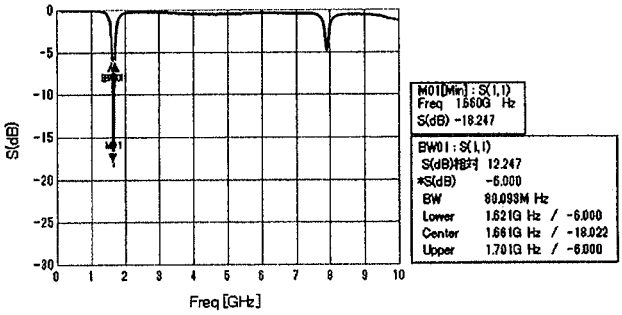
Figure 10A:
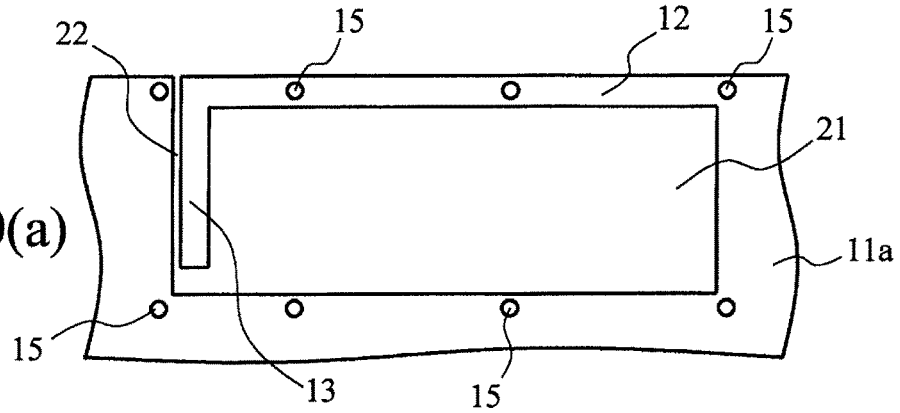
FIG. 10 are explanatory diagram showing a metal substrate of each layer, and, a stripline in the fifth embodiment.
Figure 10B:
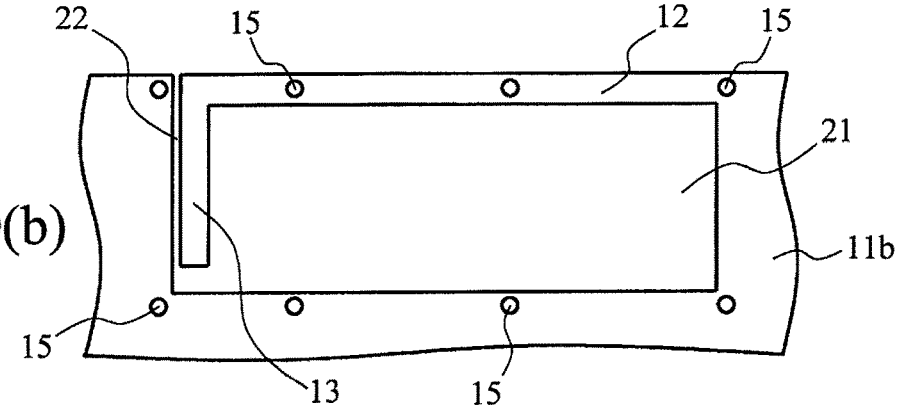
Figure 10C:
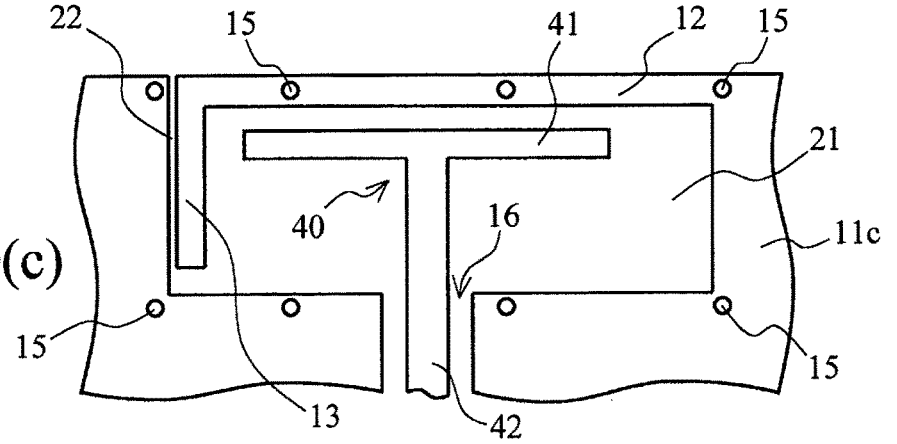
Figure 10D:
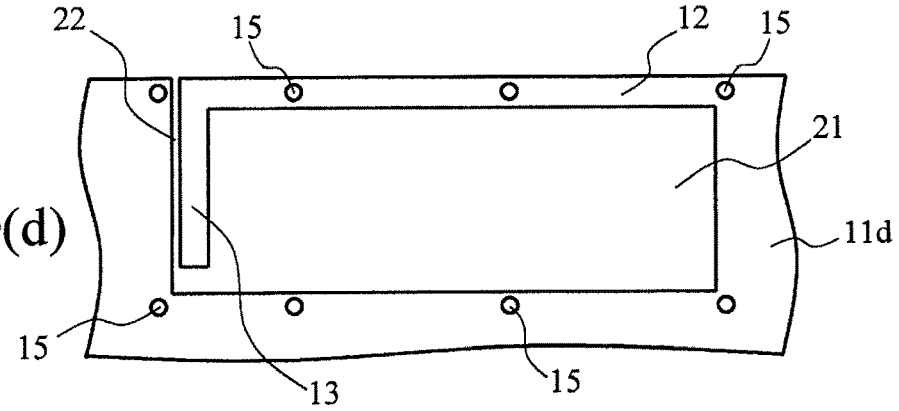
Figure 11A:
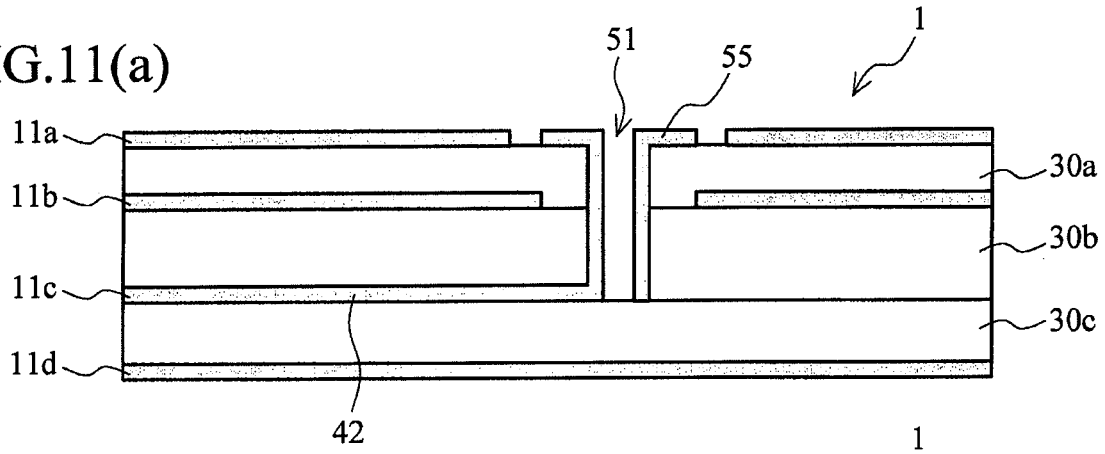
FIG. 11 are sectional diagrams showing various shapes of the end side of a second line section 42 to be connected to an external high frequency circuit in the fifth embodiment.
Figure 11B:
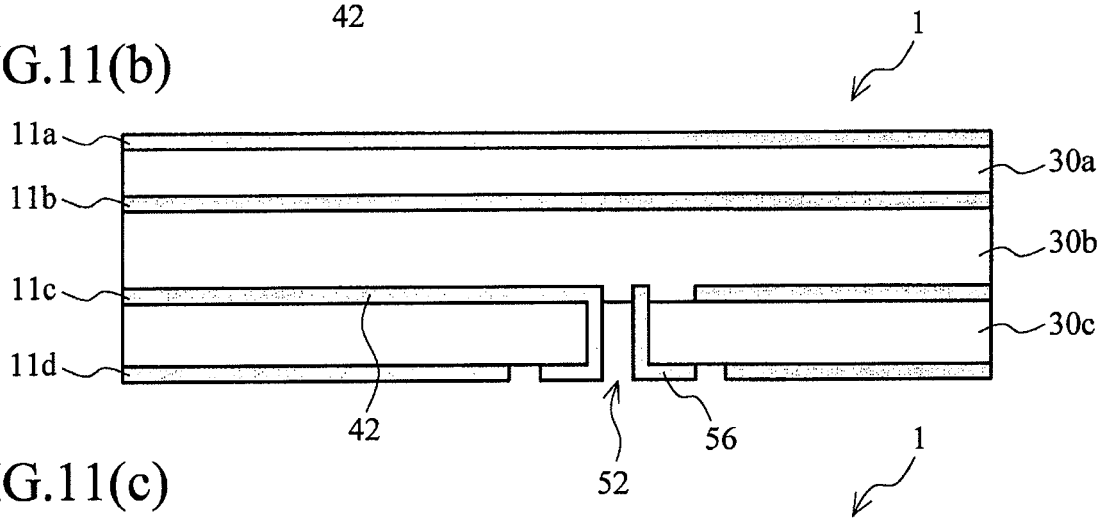
Figure 11C:
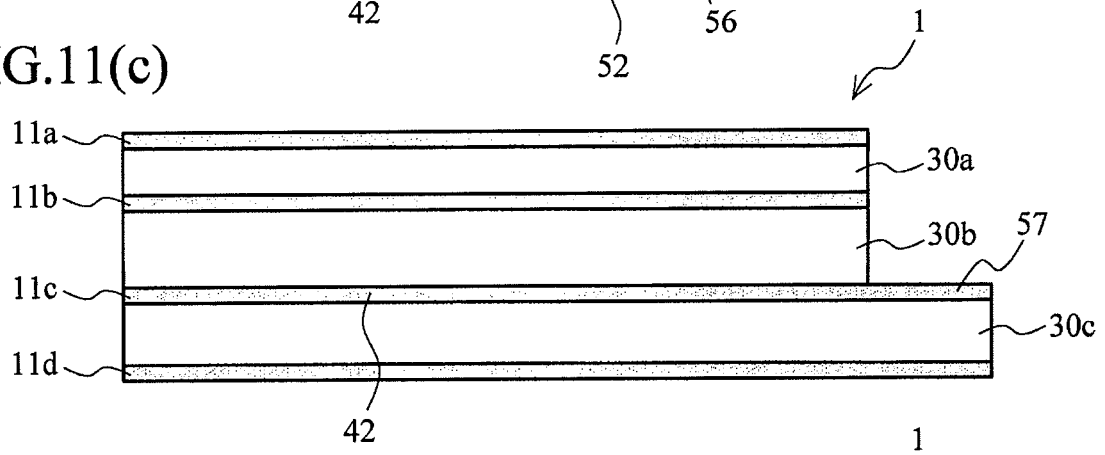
Figure 11D:
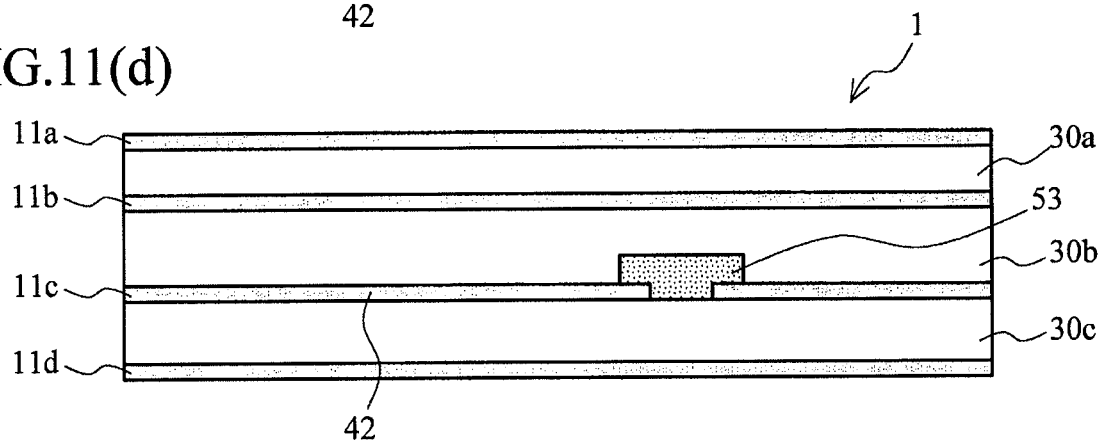
Figure 12A:
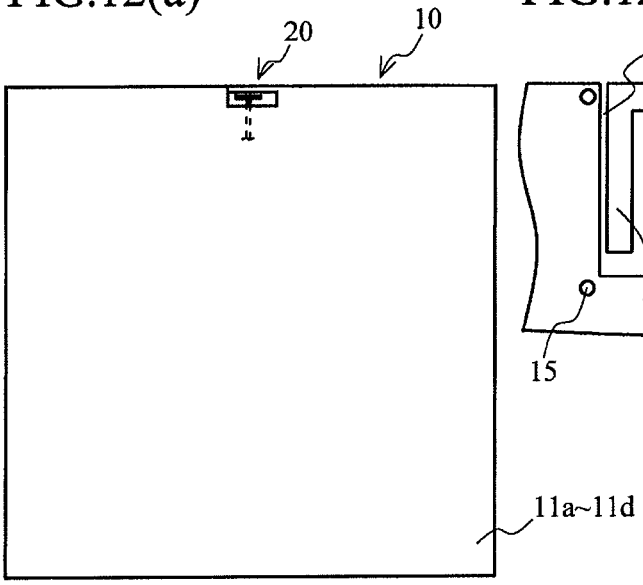
FIG. 12 are explanatory diagrams showing a configuration and characteristics of a compact slot-type antenna in a sixth embodiment.
Figure 12B:
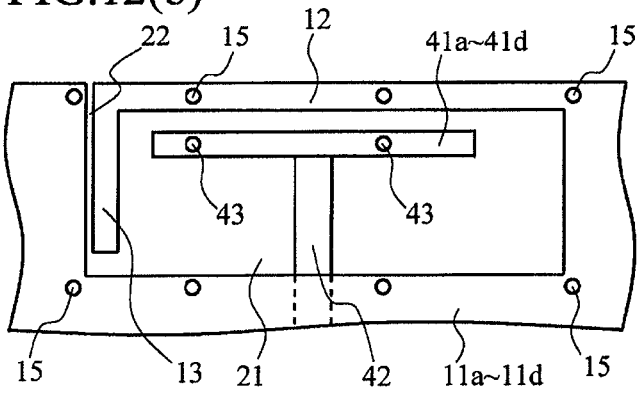
Figure 12C:
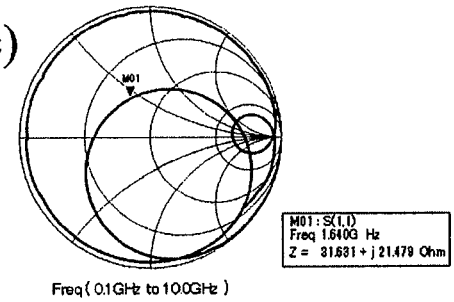
Figure 12D:
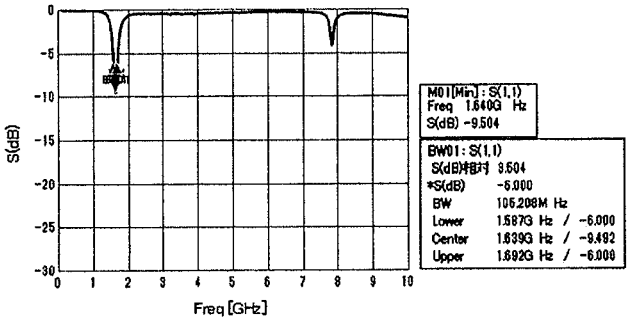
Figure 13A:
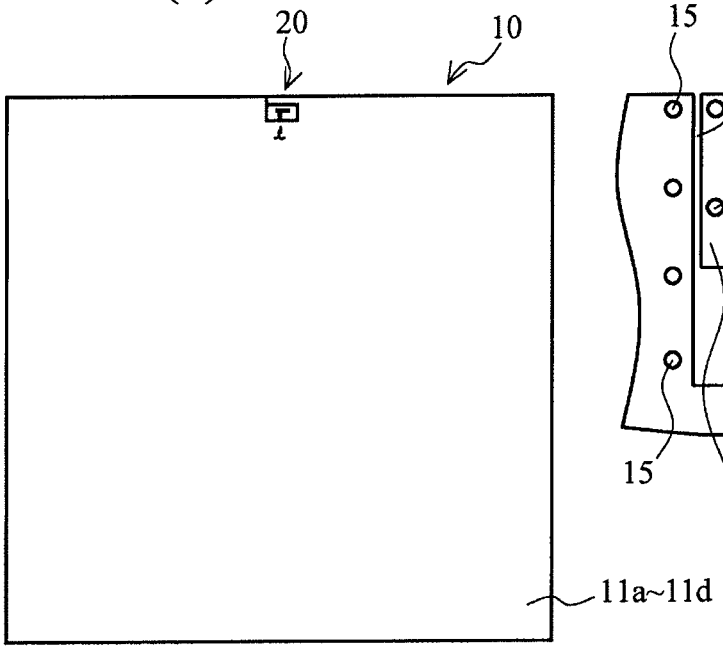
FIG. 13 are explanatory diagrams showing a configuration and characteristics of a compact slot-type antenna in a seventh embodiment.
Figure 13B:
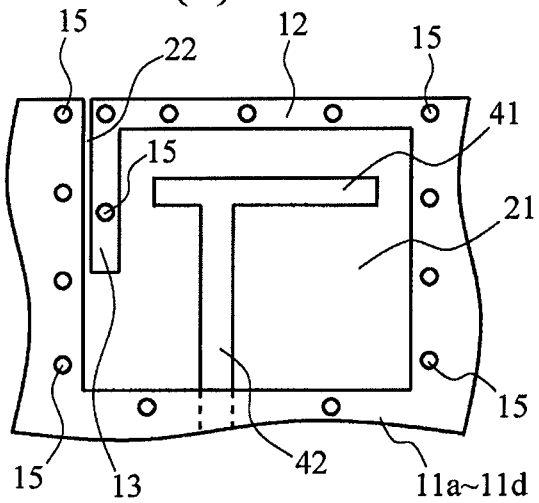
Figure 13C:
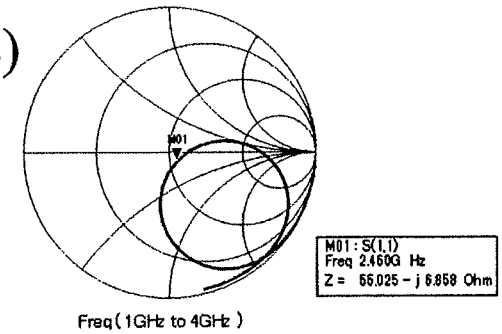
Figure 13D:
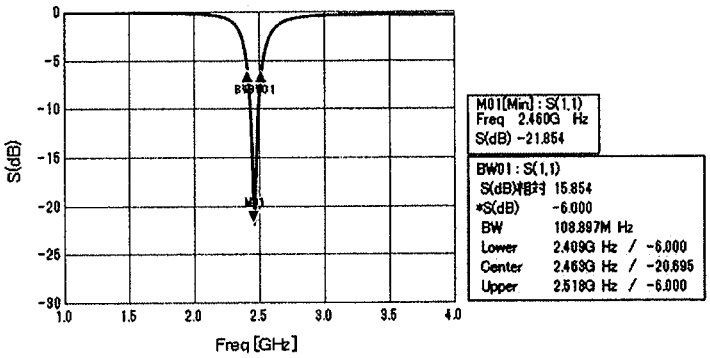

FIG. 3 are the ones showing definitions of respective sections and parameters for defining the sizes thereof of the compact slot-type antenna 20 in each embodiment succeeding to the second embodiment.

FIG. 3(*a*) is an example of the case of the second embodiment that the slit 22 has been formed in the slot end substrate section 12, (b) is an example of a case of third and succeeding embodiments that the slit has been formed by an inward-extended section 13 which has been formed by extending the metal substrate 11 from the slit-side end of the slot end substrate section 12 in an intra-slot 21 direction.

As shown in FIG. 3(*a*), it is assumed that as parameters indicting the size of the metal substrate 11 (and the dielectric 30), a transverse length is L1, a longitudinal length is L2, and a thickness of the entire of the compact slot-type antenna 20 (the compact slot-type antenna module 10) is L3.

Incidentally, in each embodiment which will be described, since the metal substrate 11 and the stripline 40 are formed by metallic thin films, the thickness thereof is regarded to be almost 0 mm and is not included in the value of the thickness L3. Accordingly, although it is indicated as the thickness L3 (=the thickness of the dielectric 30), the actual thickness is the thickness to which the thicknesses of the metallic thin films have been added (in a case where a metal plate which is thicker than them has been used, the thickness thereof).

It is assumed that as parameters for indicating the size of the slot 21, a transverse (the longitudinal direction) length is a and a longitudinal length (a width) is b.

It is assumed that as parameters for indicating the stripline 40, a width of the second line section 42 is T3, a length on the slit 22 side of the first line section 41 from which this width T3 has been excluded is T1, a length on the opposite side is T2, and a length of the entire first line section 41 is T (=T1+T2+T3). In addition, it is assumed that a width of the first line section 41 is T4.

It is assumed that a width (a length from the slot 21 to the end face of the metal substrate 11) of the slot end substrate section 12 is m.

It is assumed that a space (a gap) between the first line section 41 and the slot end substrate section 12 is G.

It is assumed that a distance (an offset value) between the center of the slot 21 and the center of the width of the second line section 42 is c.

It is assumed that as parameters for indicating the size of the slit 22, a length thereof is S and a width is d.

Incidentally, it is assumed that as shown in FIG. 3(*a*), a slit formed in the slot end substrate section 12 is called an outward-directed slit 22 and as shown in FIG. 3(*b*), a slit which is formed between the inward-extended section 13 and the short side of the slot 21 is called an inward-directed slit 22.

In the case of the outward-directed slit 22, the length thereof S equals the width m of the slot end substrate section 12, and in the case of the inward-directed slit 22, the length thereof S demotes the sum of the width m and the length of the inward-extended section 13.

In addition, in the respective embodiments succeeding to the second embodiment, since the following parameters have the same values, the values thereof will be described next and description thereof in the respective embodiments is omitted.

The width T4 of the first line section 41=0.5 mm, the width d of the slit 22=0.1 mm.

The width m of the slot end substrate section 12=0.5 mm and a width of the inward-extended section 13=0.5 mm in the third and succeeding embodiments which will be described later.

In addition, the gap G between the first line section 41 and the slot end substrate section 12 is G=0.5 mm in a case where the inward-directed slit 22 has been formed, G=0.4 mm in a case where the outward-directed slit 22 has been formed.

FIG. 4 are explanatory diagrams showing the configuration and the characteristics of the second embodiment in the compact slot-type antenna 20.

The compact slot-type antenna 20 in the second embodiment is the one which has been miniaturized by setting the resonance frequency to f=2.4 GHz band and providing the outward-directed slit 22.

The size of this compact slot-type antenna 20 has the values shown in FIG. 3(*a*) and is as follows.

That is, the size of the compact slot-type antenna module 10 is the transverse length L1=100 mm, the longitudinal length L2=100 mm, the thickness L3=0.4 mm, and the width m of the slot end substrate section 12=the length S of the outward-directed slit 22=3 mm.

The size of the slot 21 is the transverse length a=16 mm and the width b=1.2 mm.

The size of the stripline 40 is the total length T of the first line section 41=10 mm, the length T1=3.2 mm, the length T2=6 mm, the width T3 of the second line section 42=0.8 mm, the gap G=0.4 mm, and the offset value s=1.5 mm.

According to the compact slot-type antenna 20 of this second embodiment, further miniaturization is realized by adjusting (see A2 in FIG. 4(*d*)) the resonance frequency that the compact slot-type antenna 22 shown in FIG. 2 has lowered (f=1.02 GHz) by providing the outward-directed slit 22 to f=2.4 GHz band.

That is, while in the compact slot-type antenna 20 in FIG. 2, the size of the slot 21 is a=47 mm×b=1.2 mm, the size of the slot 21 in the compact slot-type antenna 20 of the second embodiment is a=16 mm×b=1.2 mm and the size of the breadth is about ⅓.

Then, since the slot 21 of the compact slot-type antenna 20 in FIG. 2 has the same size as the slot 21 of the compact slot-type antenna 20 in the first embodiment shown in FIG. 1, the compact slot-type antenna 20 of the second embodiment can be reduced to ⅓ in size of its breadth even when compared with the compact slot-type antenna 20 in the first embodiment and further miniaturization is realized.

Incidentally, as shown in FIG. 4(*d*), the radiation efficiency in the second embodiment is η=89.9% (2.40 GHz) and a value which is higher than that in the first embodiment is obtained.

Next, the third embodiment will be described.

FIG. 5 are explanatory diagrams showing a configuration and characteristics of the third embodiment in the compact slot type antenna 20.

While the compact slot-type antenna 20 in the second embodiment has been provided with the outward-directed slit 22, in the compact slot-type antenna 20 of this third embodiment, the inward-directed slit 22 has been provided.

Also the compact slot-type antenna 20 of the third embodiment is formed as the antenna of the resonance frequency f=2.4 GHz band similarly to that in the second embodiment.

As shown in FIG. 5(*b*), the compact slot-type antenna 20 is formed with the inward-directed slit 22 which extends from the slot end substrate section 12 in an inward direction of the slot 21.

That is, the inward-extended section 13 which extends from the slit-side end of the slot end substrate section 12 into the slot 21 is formed in the compact slot-type antenna 20 and the inward-directed slit 22 is formed between one of the long sides which extend in an extending direction of this inward-extended section 13 and the slot 21.

The size of the compact slot-type antenna 20 in the third embodiment has the values shown in FIG. 3(*a*) and is as follows.

That is, the compact slot-type antenna module 10 is the transverse length L1=100 mm, the longitudinal length L2=100 mm, the thickness L3=0.4 mm, the gap G=0.5 mm, the offset value s=1.5 mm and these values are the same as those in the second embodiment.

On the other hand, the slot 21 in the third embodiment is the transverse length a=15 mm, the width b=2 mm, the width m of the slot end substrate section 12=0.5 mm, the length S of the inward-directed slit 22=2 mm, the total length T of the first line section 41=6.8 mm, the length T1=T2=3 mm, the width T3 of the second line section 42=0.8 mm, differently from that in the second embodiment.

In this embodiment, the inward-extended section 13 is formed in the slot 21 and the inward-directed slit 22 is formed between both of them and thereby the slit length S of a predetermined amount can be ensured.

That is, in the second embodiment, since the slit length S of the outward-directed slit 22 equals the width m of the slot end substrate section 12, it is necessary to ensure the width m of the slot end substrate section 12 in order to ensure the slit length S of the predetermined amount.

In contrast, in the inward-directed slit 22 of the present embodiment, since the inward-directed slit 22 is formed in the slot 21, the width of the slot end substrate section 12 can be narrowed while ensuring the slit length S of the predetermined amount.

Thereby, it becomes possible to form the compact slot-type antenna 20 by bringing it closer to the end side of the compact slot-type antenna module 10.

In the compact slot-type antenna 20 of the present embodiment, although the width b of the slit 21=2 mm in order to form the inward-extended section 13 and is made wider than the same width b in the second embodiment=1.2 mm, the width m of the slot end substrate section 12=0.5 mm and has the value which is smaller in comparison with the same width m in the second embodiment=3 mm.

Accordingly, while the value of the total value (b+m) of the both widths is 4.2 mm in the second embodiment, it is 2.5 mm in the present embodiment and the area which is required for formation of the compact slot-type antenna 20 including the slot end substrate section 12 can be more miniaturized.

Incidentally, the characteristics of the compact slot-type antenna 20 in the third embodiment are as shown in FIGS. 5(*c*), (*d*), the radiation efficiency at 2.45 GHz is =80.0% and the characteristics which are sufficient as the antenna are ensured.

FIG. 6 are the ones that comparison has been made in regard to the resonance frequency, the bandwidth BW, the efficiency depending on whether the direction in which the slit 22 is formed is the outward-directed slit 22 or the inward-directed slit 22.

FIG. 6(*a*) is a table indicating characteristic values (the resonance frequency, the bandwidth, the efficiency) of the respective compact slot-type antennas 20 in a case where the lengths S of the outward-directed slit 22 and the inward-directed slit 22 have been changed and the one which has indicated a change in resonance frequency is (b) and the one which has indicated the bandwidth is (c) in the characteristic values.

Incidentally, the slit length S in FIG. 6(*a*) and the value S of the x-axis in (b), (c) are for the inward-directed slit 22 in a case where the x-axis is minus and for the outward-directed slit 22 in a case where it is minus, with the case of the outward-directed slit 22 in the case of the width m of the slot end substrate section 12=0.5 mm being set as the standard (S=0.5).

In FIG. 6, similarly to the compact slot-type antenna 20 which will be described later in a sixth embodiment in FIG. 12, in the compact slot-type antenna 20 in the case of S=0.5 mm which is set as the standard is, the metal substrate 11 and the first line section 41 are formed to be plural-layered (four-layered) (the second line section 42 is single-layered), the respective layers of the metal substrate 11 and the respective layers of the first line section 41 are individually via-connected with one another.

Then, in FIG. 6, the dimensions of the respective sections of the compact slot-type antenna 20 in the case of S=0.5 mm which is set as the standard are as follows.

That is, the compact slot-type antenna 10 is the transverse length L1=50 mm, the longitudinal length L2=30 mm, the width m of the slot end substrate section 12=0.5 mm, the slot 21 is the transverse length a=5.05 mm, the longitudinal length b=4.5 mm, and is the gap G=0.5 mm, the offset value s=0.55, the width d of the slit=0.1 mm, the length T of the first line section 41=3.45 mm, the width T4 of the first line section 41=0.5 mm, the width T3 of the second line section 42=0.55 mm.

In regard to other compact slot-type antennas 20, they are made as the antennas (multi-layered) of the same shape excepting that the value of the gap G has been adjusted in order to improve matching in the case of the outward-directed slit 22. The gap G of the outward-directed slit 22 is the gap G=0.3 mm in the case of S=1.5 mm and the gap G=0.1 mm in the case of S=2.5 to 4.5 mm.

It is found from these FIG. 6 that although in regard to the outward-directed slit 22, the characteristics change in accordance with the length thereof, in regard to the direction, the almost the same characteristics are obtained from the inward-directed slit 22 and the outward-directed slit 22.

Incidentally, although FIG. 6 show the results of simulation of each compact slot-type antenna 20 that the metal substrate 11 and the first line section 41 have been multi-layered, almost the same characteristics are obtained from the inward-directed slit 22 and the outward-directed slit 22 also in regard to the compact slot-type antenna 20 that the metal substrate 11 and the first line section 41 have been single-layered.

That is, although the values of the resonance frequency, the bandwidth, the efficiency for each compact slot-type antenna 20 which has been single-layered are different from the values in FIG. 6, the inward-directed slit 22 and the outward-directed slit 22 have almost the same characteristic values (an almost bilaterally symmetric graph) for the compact slot-type antenna 20 in the case of S=0.5 which is set as the standard.

Next, a fourth embodiment will be described.

FIG. 7 are explanatory diagrams showing a configuration and characteristics of the compact slot-type antenna 20 in the fourth embodiment.

This compact slot-type antenna 20 of the fourth embodiment is the one that the shape of the antenna part has been arranged by making the length shorter in comparison with that in the third embodiment.

That is, while in the third embodiment, the slot 21 was the length a=15 mm, the width b=2 mm, in the compact slot-type antenna 20 in the fourth embodiment, the size of the slot 21 is set to the length a=10 mm, the width b=3.5 mm.

In addition, the radiation efficiency is heightened up to 82.7% (2.47 GHz) as shown in FIG. 7(*d*), by lengthening the length of the inward-directed slit 22 to S=3.5 mm (S=2.0 mm in the third embodiment) in association with broadening of the width of the slot 21.

Incidentally, the compact slot-type antenna module 10 in the fourth embodiment is the transverse length L1=100 mm, the longitudinal length L2=100 mm, the thickness L3=0.4 mm.

In addition, the width m of the slot end substrate section 12=0.5 mm, the total length T of the first line section 41=6.8 mm, the length T1=the length T2=3 mm, the width T3 of the second line section 42=0.8 mm, the gap G=0.5 mm, the offset value s=0.25 mm.

Next, an altered example of the fourth embodiment will be described.

FIG. 8 are explanatory diagrams showing a configuration and characteristics of the compact slot-type antenna 20 in the altered example of the fourth embodiment.

In this altered example, the case where the shapes of the slot 21 and the stripline 40 have been made the same as those in the fourth embodiment, the sizes of the metal substrate 11 and the dielectric 30 on which the compact slot-type antenna 20 is to be arranged have been miniaturized is showed.

That is, as shown in FIG. 8(*a*), the sizes of the metal substrate 11 and the dielectric 30 of the compact slot-type antenna 20 are miniaturized from 100 mm×100 mm to 30 mm×30 mm. However, in regard to the thickness, it is the same as that and is L3=0.4 mm in the thickness of the dielectric 30.

Incidentally, as described above, in regard to the sizes of respective sections of the compact slot-type antenna 20 shown in FIG. 8(*b*), they are the same as those of the compact slot-type antenna 20 of the fourth embodiment shown in FIG. 7(*b*).

In the compact slot-type antenna 20 according to the altered example of the fourth embodiment, the radiation efficiency η is lowered from 82.7% to 74.0% in association with miniaturization as shown in FIG. 8(*d*).

However, also in the compact slot-type antenna, it is possible to set it to not more than 1/10 in area ratio of the metal substrate 11, while ensuring the sufficient radiation efficiency of at least 50% and loading thereof on compact electronic equipment is possible.

Next, a fifth embodiment will be described.

In each of the compact slot-type antennas 20 in the first embodiment to the fourth embodiment, as shown in FIG. 1(*c*), the stripline 40 has been arranged on the other face of the one-layered metal substrate 11 with the dielectric 30 being interposed.

In contrast, in the fifth embodiment and each embodiment succeeding to the fifth one, the compact slot-type antenna 20 has been made into a multi-layered structure by providing the metal substrate 11 plural-layeredly and dielectrics 30*a* to *c* have been arrange between metal substrates 11*a* to *d* of the respective layers.

FIG. 9 are explanatory diagrams showing a configuration and characteristics of the compact slot-type antenna 20 in the fifth embodiment.

The shape of this compact slot-type antenna 20 of the fifth embodiment is the one that the metal substrate 11 in the fourth embodiment has been multi-layered and the sizes and the shapes of the metal substrates 11*a* to *d* are the same as one another. Incidentally, in FIG. 9, in regard to the metal substrates 11*a* to *d* of the respective layers, they are shown altogether by the metal substrate 11 (the same shall apply hereinafter).

However, the dielectrics 30*a* to *c* (not shown) are interposed between the metal substrates 11*a* to *d* of the respective layers and the respective metal substrates 11 are via-connected with one another via through-holes 15 formed around the slot 21 in association with multi-layering.

The size of the compact slot-type antenna module 10 in the fifth embodiment is the transverse length L1=100 mm, the longitudinal length L2=100 mm, the thickness L3=1.4 mm, the width m of the slot end substrate section 12=0.5 mm.

The slot 21 is the transverse length a=10 mm, the width b=3.5 mm, the size of the first line section 41 is the total length T=6.8 mm, the length T1=T2=3 mm, and the size of the second line section 42 is the width T3=0.8 mm, the gap G=0.5 mm, and the offset value s=0.25 mm. In addition, the inward-directed slit 22 is the length S=3.5 mm.

Incidentally, the thickness L3=1.4 mm of the compact slot-type antenna module 10 is the thickness of the entire of the dielectrics 30*a* to *c* as described above, and in the present embodiment, the thicknesses of the dielectrics 30*a*, 30*c* which are interposed between the metal substrate 11*a* of the first layer and the metal substrate 11*b* of the second layer and between the metal substrate 11*c* of the third layer and the metal substrate 11*d* of the fourth layer are respectively 0.4 mm. In addition, the thickness of the dielectric 30*b* which is interposed between the metal substrate 11*b* of the second layer and the metal substrate 11*c* of the third layer is 0.6 mm.

FIG. 10 are the ones which have shown in regard to the metal substrates 11*a* to 11*d* of the respective layers and the stripline 40.

FIGS. 10(*a*), (*b*), (*d*) are the ones showing states of the first, second and fourth layers and they are configured by the metal substrates 11*a, b, d* of the same shape and size. However, as described later in FIG. 11, through-holes are formed corresponding to power feeding terminals 55 to 57 which are formed on an end on the side of the second line section 42 which is not connected with the first line section 41.

FIG. 10(*c*) is the one showing a state of the third layer and it is configured by the metal substrate 11*c* of the third layer and the stripline 40. In this fifth embodiment, the stripline 40 is formed only in the third layer.

A slit 16 for power feeding section for avoiding electric connection with the stripline 40 and for making the second line section 42 pass through it is formed in the metal substrate 11*c* of the third layer. This slit 16 for power feeding section is formed so as to be slightly longer than the length up to the end of the second line section 42.

The stripline 40 is arranged on the same plane as the metal substrate 11*c* of the third layer and the second line section 42 is arranged in the slit 16 for power feeding section.

As shown in FIG. 10, in each of the respective metal substrates 11*a* to *d*, through-holes 15 for via-connection are formed plurally at the same positions surrounding the slot 21.

Incidentally, though not shown, in regard to the though-holes 15, they may be formed in the entire of the metal substrates 11*a* to *d*, not only around the slot 21.

Incidentally, including the fifth embodiment, although a case where the thickness of the dielectric 30 which is arranged between the respective layers is 0.4 mm between the first, second layers and between the third, fourth layers and is 0.6 mm between the second, third layers has been described, the thickness between the respective layers is optional.

In addition, although in the fifth embodiment, the stripline 40 is arranged in the third layer, it may be arranged in any layer. However, it is necessary to arrange the metal substrate 11 (see FIG. 10(*c*)) in which the slit 16 for power feeding section has been formed in the layer that the stripline 40 has been arranged.

FIG. 11 are sectional diagrams showing various shapes of the end side of the second line section 42 which is connected to an external high frequency circuit.

FIG. 11(*a*) is a first example of a case where the power feeding terminal 55 has been arranged on the metal substrate 11*a* side of the first layer in the compact slot type antenna module 10.

That is, a though-hole 51 is formed in the dielectric 30*a* and the dielectric 30*b* at a position corresponding to a power feeding end of the second line section 42 and an opening which is larger than the through-hole 51 is formed in the metal substrate 11*a* of the first layer and the metal substrate 11*b* of the second layer, and the power feeding terminal 55 is formed in the opening.

Then, the power feeding terminal 55 and the end of the second line section 42 are via-connected with each other by plating an inner circumferential surface of the through-hole 51 or filling the through-hole 51 with a conductive paste.

FIG. 11(*b*) is a second example of a case where the power feeding terminal 56 has been formed on a surface opposite to that in the first example, that is, on the metal substrate 11*d* side of the fourth layer.

In this example, a though-hole 52 is formed in the dielectric 30*c* at a position corresponding to the power feeding end of the second line section 42 and the power feeding terminal 56 is formed in an opening provided in the metal substrate 11*d* of the fourth layer.

Then, the power feeding terminal 56 and the end of the second line section 42 are via-connected with each other by plating an inner circumferential surface of the through-hole 52 or filling the through-hole 52 with the conductive paste.

FIG. 11(*c*) is the one that the length of the dielectric 30*c* in a length direction of the second line section 42 has been formed longer than those of the dielectric 30*a* and the dielectric 30*b* and also the second line section 42 has been formed longer than the dielectric 30*a*, the dielectric 30*b*.

In this case, the end of the second line section 42 functions as the power feeding terminal 57.

Incidentally, although, in FIG. 11(*c*), also the metal substrates 11*c, d* of the third, fourth layers which interpose the dielectric 30*c* between them are formed larger than the metal substrates 11*a, b* of the first, second layers in conformity with that the dielectric 30*c* has been made larger than the dielectrics 30*a, b*, the metal substrates 11*c, d* may be made smaller (shortening a length direction of the second line section) than the dielectric 30*c* and thereby they may be formed into the same size as that of the metal substrates 11*a, b* of the first, second layers.

FIG. 11(*d*) is the one that the though-holes and so forth are not formed, the second line section 42 has been formed integrally with a main circuit substrate as it is so as to be connected to the high frequency circuit via another electric element 53 (another circuit pattern) of the main circuit substrate.

Incidentally, as described in FIG. 10, the same also applies to other embodiments that the metal substrate 11 is provided plural-layeredly in the point that the slit 16 for power feeding section is formed in the metal substrate 11 of the layer that the second line section 42 is arranged and the shapes, the sizes of the others are the same as those of the metal substrates 11 of other layers.

In addition, as described in FIG. 11, the shape of each layer corresponding to the second line section 42 end is the same as those also in other embodiments that the metal substrate 11 is provided plural-layeredly.

As above, in the fifth embodiment, the compact slot-type antenna 20 that the metal substrate 11 in the fourth embodiment has been multi-layered has been described.

As described in FIG. 7, the compact slot-type antenna 20 of the fourth embodiment is the resonance frequency f=2.47 GHz.

In contrast, according to the compact slot-type antenna 20 of the fifth embodiment that the metal substrate 11 of the same shape as that in the fourth embodiment has been multi-layered, the resonance frequency is lowered to f=1.66 GHz owing to multi-layering as shown in FIG. 9(*d*).

Accordingly, such a new finding that the resonance frequency of the compact slot-type antenna 20 which has been miniaturized by formation of the slit 22 is lowered (it is possible to lower the resonance frequency) by multi-layering the metal substrate 11 was obtained.

That is, the finding that in the same resonance frequency band (f=2.4 GHz band) as that, it is possible to make the size of the antenna of the compact slot-type antenna 20 smaller by multi-layering of the metal substrate, in addition to miniaturization owing to formation of the slit 22 which is linked to the slot 21 was obtained.

Incidentally, although in the fifth embodiment, multi-layering in the case of the inward-directed slit 22 has been described, as described in FIG. 6, also in the compact slot-type antenna 20 that the metal substrate 11 for the outward-directed slit 22 has been multi-layered, the resonance frequency is lowered in the same way as exhibited almost the same characteristics in the inward-directed slit 22 and the outward-directed slit 22.

Next, a sixth embodiment will be described.

In the fifth embodiment, description has been made in regard to that the resonance frequency is lowered by making the metal substrate 11 into the multi-layered structure. Then, in the fifth embodiment, the stripline 40 has been arranged on the same plane as the metal substrate 11*c* of the third layer.

In contrast, in the sixth embodiment, the metal substrate 11 and the dielectric 30 which have been multilayered are made the same as those in the fifth embodiment and the first line section 41 of the stripline 40 has been multi-layered.

FIG. 12 are explanatory diagrams showing a configuration and characteristics of the compact slot-type antenna 20 in the sixth embodiment.

In the compact slot-type antenna 20 of this sixth embodiment, four first line sections 41*a* to *d* are arranged respectively on the metal substrates 11*a* to *d* of the respective layers.

As shown in FIG. 12(*b*), through-holes 43 are formed at the same positions in the respective first line sections 41*a* to *d* and they are via-connected with one another. Incidentally, although in the drawings, a case where the two through-holes 43 are formed, making it to three or more is also possible.

In the present embodiment, the second line section 42 is arranged on the same plane as the metal substrate 11 of the third layer similarly to the fifth embodiment.

That is, as described in FIG. 10(*c*), the slit 16 for power feeding section is formed in the metal substrate 11*c* of the third layer.

Then, the second line section 42 which has been connected with the first line 41*c* of the third layer is arranged in this slit 16 for power feeding section. Since the other-end side of the second line section 42 is the same as that described in FIG. 11, description thereof is omitted.

According to the compact slot-type antenna 20 of the present embodiment, as shown in FIG. 12(*d*), the resonance frequency is lowered to f=1.64 GHz similarly to that in the fifth embodiment owing to lamination of the metal substrate 11 in comparison with the case where the metal substrate 11 is single-layered. As for the radiation efficiency, it is the radiation efficiency $\eta$=75.5% which is almost the same as that in the fifth embodiment.

In addition, in the compact slot-type antennas 20 in the first to fifth embodiment that the first line section 41 is single-layered, it is the critical coupling state to the under (loose) coupling state in either case.

In contrast, in the present embodiment, as shown in FIG. 12(*c*), it becomes over (tight) coupling by multi-layering the first line section 41.

Accordingly, it becomes possible to freely adjust a state (the coupling amount) of impedance matching to over, critical, under owing to lamination of the first line section 41.

In addition, in regard to this coupling amount, it is also possible to adjust it by changing the space (the gap G) between the first line section 41 and the slot end substrate section 12.

That is, it is possible to increase the coupling amount by making the gap G small so as to put it into the over coupling state and to decrease the coupling amount by making the gap G large so as to put it into the critical coupling state.

Next, a seventh embodiment will be described.

In the fifth embodiment, it is possible to lower the resonance frequency f by multi-layering the metal substrates 11 of the same shape in comparison with the case of single-laying (the resonance frequency f=2.4 GHz band).

Therefore, in the seventh embodiment, the compact slot-type antenna 20 has been more miniaturized by multi-layering the metal substrate 11 so as to bring it to the resonance frequency f=2.4 GHz band.

FIG. 13 are explanatory diagrams showing a configuration and characteristics of the compact slot-type antenna 20 in the seventh embodiment.

In the compact slot-type antenna 20 of the seventh embodiment, as shown in FIGS. 13(*a*), (*b*), the shape thereof is optimized such that it becomes the resonance frequency f=2.4 GHz.

That is, the size of this compact slot-type antenna 20 has the values shown in FIG. 3(*a*) and is as follows.

The compact slot-type antenna module 10 is the transverse length L1=100 mm, the longitudinal length L2=100 mm, the thickness L3=1.4 mm. In addition, the width m of the slot end substrate section 12=0.5 mm.

The slot 21 is the transverse length a=5 mm, the width b=4 mm.

The total length T of the first line section 41=3.4 mm, the length T1=0.7 mm, the length T2=2.2 mm, the width T3 of the second line section 42=0.5 mm, the gap G=0.7 mm, the offset value s=0.45 mm. Incidentally, the gap G is widened in order to decrease the coupling amount.

The inward-directed slit 22 is the length S=2.7 mm.

In the present embodiment, the metal substrate 11 and the dielectric 30 are multi-layered and the stripline 40 is single-layered and is formed on the metal substrate 11*c* which is the third layer of the metal substrate 11*c*, similarly to the fifth embodiment.

Incidentally, although in the compact slot-type antenna 20 of the present embodiment, as shown in FIG. 13(*b*), the through-holes 15 are formed also in the inward-extended section 13 adapted to form the inward-directed slit 22 and the inward-directed sections 13 of the respective layers are via-connected with one another, the through-holes in the inward-oriented sections 13 and via-connection thereof may be eliminated similarly to the fifth and sixth embodiments.

Conversely, the through-holes 15 may be also formed in the inward-directed sections 13 of the fifth and sixth embodiments thereby to via-connect them with one another similarly to the present embodiment.

According to the compact slot-type antenna 20 of the present invention, when comparing the sizes of the slots 21 in the compact slot-type antennas 20 which adopt the inward-directed slits 22 with one another in area ratio, the present embodiment is miniaturized by about 67% in comparison with the third embodiment and about 57% in comparison with the fourth and fifth embodiments in area ratio.

Then, as shown in FIG. 13(*d*), a sufficient performance that the radiation efficiency at the resonance frequency f=2.46 GHz is $\eta$=74.8% is ensured.

As above, although the first to seventh embodiments and the altered example have been described, the present invention is not limited to them and various alterations are possible within the range described in each claim.

For example, in the embodiments which have been described, as the shape of the stripline 40, it has been made into the T-shaped stripline 40 in the case where the second line section 42 is connected to the predetermined position which is located closer to the center away from the both ends of the first line section 41, that is, by setting both of the lengths T1 and T2 to T1>0, T2>0.

In contrast, it may be made into an L-shaped stripline 40 by setting any one of the values of T1 and T2 to zero.

In addition, although in the respective embodiments which have been described, the case where the slit 22 has been formed on the left side in each drawing relative to the slot 21 has been described by way of example, it may be formed on the opposite side (the right side in the drawing). However, in the case of the inward-directed slit 22, the inward-extended section 13 is formed on the same side.

In addition, in the case of the outward-directed slit 22, it may be formed closer to the center away from the end of the slot 21 other than the case where it is formed in the end of the slot 21. However, it is necessary to form of the outward-directed slit 22 between the end of the slot 21 and the end on the same side of the first line section 41.

In addition, although in the respective embodiments, the altered example which have been described in FIG. 1 to FIG. 8, the case where the metal substrate 11 is made the single-layered one which has been set as the standard and the stripline is arranged with the dielectric 30 being interposed (two layers of the metal substrate 11 and the stripline 40) has been described, the stripline 40 may be arranged on the same plane as the metal substrate 11.

That is, the compact slot-type antenna 20 may be configured only by the third layer in FIG. 10(*c*) in FIG. 10 that the case where it is multi-layered has been described. In this case, since the metal substrate 11*c* and the stripline 40 exist on the same plane, the dielectric 30 which is interposed between them does not exist. However, it is possible to fill the slot 21 with the dielectric.

In addition, in the respective embodiments, the altered example which have been described, the case where the slot 21 is formed in the end of the metal substrate 11 and the stripline 40 is arranged corresponding thereto, that is, the case where the compact slot-type antenna 20 is arranged on the end has been described.

In contrast, the slot 21 (the compact slot-type antenna 20) may be arranged at other positions such as the center, a corner part and so forth of the metal substrate 11.

In particular, since the compact slot-type antenna 20 of the present embodiment is sufficiently miniaturized in comparison with the conventional slot-type antenna, the degree of freedom relating to the arrangement position of the antenna is high. Therefore, the degree of design freedom in a case where it has been applied to the antenna of portable equipment can be improved.

As described above, according to the present embodiment and the altered example, as a system for feeding the electric power to the metal substrate 11 around the slot 21, not the direct power feeding by electrical connection but electromagnetic coupling type power feeding by electromagnetic connection by the first line section 41 is taken.

Then, since the first line section 41 is arranged in the projection area of the slot 21, it can be more miniaturized in comparison with the conventional slot antenna that the stripline 40 has projected to the outside of the slot 21.

In addition, in a case where the same resonance frequency has been set as the standard, the compact slot-type antenna 20 can be more miniaturized by providing the slit 22 on the basis of the new finding that when the slit from the slot 21 to the side of the metal substrate 11 is formed, the resonance frequency f is lowered.

In addition, since the length S of the inward-directed slit 22 can be sufficiently ensured by making the slit 22 into the inward-directed slit 22, it becomes possible to narrow the width of the slot end substrate section 12. Thereby, it becomes possible to arrange the compact slot-type antenna 20 closer to the end side and the corner of the metal substrate 11. In addition, in compact electronic equipment having a communication function such as a portable terminal and so forth, arrangement including other components is facilitated by using the compact slot-type antenna 20.

Further, in the case where the same resonance frequency has been set as the standard, the compact slot-type antenna 20 can be more miniaturized by multi-layering the metal substrate 11 on the basis of the new finding that when the metal substrate 11 of the compact slot-type antenna 20 is multi-layered, the resonance frequency is lowered.

EXPLANATIONS OF LETTERS OR NUMERALS

10 compact slot-type antenna module
20 compact slot-type antenna
11 metal substrate
12 slot end substrate section
13 inward-extended section
15 through-hole
16 slit for power feeding section
21 slot
22 slit (outward-directed slit, inward-directed slit)
30 dielectric
40 stripline
41 first line section
42 second line section
43 through-hole

The invention claimed is:

1. A compact slot-type antenna, comprising:

a conductor plate in which a slot is formed;

a stripline having a first line section formed in a longitudinal direction of said slot, and a second line section arranged in a direction orthogonal to said first line section and one end of which is connected with said first line section; and a dielectric arranged between said conductor plate and said stripline, wherein said first line section of said stripline is arranged wholly within a projection area of said slot and is electromagnetically coupled with said conductor plate around said slot by power feeding from said second line section, and said conductor plate has a slit formed therein that has a width substantially narrower than a width of said slot and that extends from said slot to a side of said conductor plate which faces a long side of said first line section.

2. The compact slot-type antenna according to claim 1, wherein said slit extends from a long side of said slot to said side of said conductor plate.

3. The compact slot-type antenna according to claim 1, wherein said conductor plate is provided with a slot end section between said slot and said side of said conductor plate, and an inward-extended section extending from said slot end substrate section into said slot, and said slit extends into said slot between a side in a transverse direction of said slot and said inward-extended section.

4. The compact slot-type antenna according to claim 1, wherein said conductor plate comprises a plurality of conductor plates arranged in layers one over the other at predetermined intervals and via-connected with one another, and said stripline is arranged on the same plane as any one of said conductor plates.

5. The compact slot-type antenna according to claim 1, wherein said conductor plate comprises a plurality of conductor plates arranged in layers one over the other at predetermined intervals and via-connected with one another, and said stripline comprises a plurality of said first line sections arranged one on each conductor plate and via-connected with one another, and the second line section is electrically connected with the first line section on any one of the conductor plates.

6. The compact slot-type antenna according to claim 1, wherein said stripline is offset from a center in a width direction of said second line section and a center of a long side of said slot in any one of left and right directions.

7. A compact slot-type antenna, comprising:

a conductor plate having an elongate slot that extends therethrough;

a stripline having a first line section that extends in a longitudinal direction of the slot and a second line section that extends in a direction orthogonal to the first line section and that is connected at one end to the first line section; and a dielectric interposed between the conductor plate and the stripline, wherein the stripline is positioned relative to the conductor plate with the slot completely overlying the first line section, the first line section is electromagnetically coupled to the conductor plate around the slot; and the conductor plate has a slit that extends therethrough from the slot to a side of the conductor plate which faces a long side of the first line section and that has a width substantially narrower than a width of the slot.

8. The compact slot-type antenna according to claim 7, wherein the slit extends from a long side of the slot to the side of the conductor plate.

9. The compact slot-type antenna according to claim 7, wherein the conductor plate has a slot end section situated between the slot and the side of the slot conductor plate, and an inward-extended section extending from the slot end section into the slot, and the slit extends into the slot between a side in a transverse direction of the slot and the inward-extended section.

10. The compact slot-type antenna according to claim 7; wherein the conductor plate comprises a plurality of conductor plates arranged in layers one over the other at predetermined intervals and electrically connected with one another, and the stripline is arranged on the same plane as any arbitrary one of the conductor plates.

11. The compact slot-type antenna according to claim 7; wherein the conductor plate comprises a plurality of conductor plates arranged in layers one over the other at predetermined intervals and electrically connected with one another, and the stripline comprises a plurality of first line sections arranged one on each conductor plate and electrically connected with one another, and the second line section is electrically connected with the first line section on any one of the conductor plates.

12. The compact slot-type antenna according to claim 7; wherein the stripline is offset from a center in a width direction of the second line section and a center of a long side of the slot in either the left or the right direction.

* * * * *